US009562368B2

(12) United States Patent
Gardner et al.

(10) Patent No.: US 9,562,368 B2
(45) Date of Patent: Feb. 7, 2017

(54) COLLAPSIBLE SUN SHELTER

(71) Applicant: ISLA LLC, Thousand Oaks, CA (US)

(72) Inventors: Chris Gardner, Thousand Oaks, CA (US); Tasche Lon Streib, Boise, ID (US)

(73) Assignee: ISLA LLC, Thousand Oaks, CA (US)

( * ) Notice: Subject to any disclaimer, the term of this patent is extended or adjusted under 35 U.S.C. 154(b) by 0 days.

(21) Appl. No.: 14/664,654

(22) Filed: Mar. 20, 2015

(65) Prior Publication Data

US 2015/0292231 A1 Oct. 15, 2015

Related U.S. Application Data

(60) Provisional application No. 61/968,503, filed on Mar. 21, 2014.

(51) Int. Cl.
*E04H 15/58* (2006.01)
*E04H 15/44* (2006.01)

(52) U.S. Cl.
CPC ..... *E04H 15/58* (2013.01); *E04H 15/44* (2013.01)

(58) Field of Classification Search
CPC ..... E04H 15/32; E04H 15/34; E04H 15/42; E04H 15/44; E04H 15/48; E04H 15/58; E04H 15/54
USPC ..... 135/87, 143–144, 151, 153, 115, 117,135/119, 120.1–120.3, 905, 907; 47/44, 20.1
See application file for complete search history.

(56) References Cited

U.S. PATENT DOCUMENTS 497,282 A * 5/1893 Morse ..... A45F 3/24 135/153
805,603 A * 11/1905 Way et al. ..... A47F 7/175 135/153
992,383 A * 5/1911 Paul ..... E04H 15/48 135/153
1,128,625 A * 2/1915 Poulnot ..... A45F 3/24 135/151
2,036,033 A 3/1936 Fisher
2,509,759 A * 5/1950 Church ..... E04H 15/18 135/120.2
2,963,030 A * 12/1960 Blanchard ..... E04H 15/42 135/116
3,101,731 A 8/1963 Stiglin
3,394,720 A 7/1968 Moss
3,434,483 A * 3/1969 Topham ..... E04H 15/003 135/118
3,965,915 A 6/1976 Kirkham
(Continued)

FOREIGN PATENT DOCUMENTS

JP 05163852 A * 6/1993

*Primary Examiner* — Winnie Yip
(74) *Attorney, Agent, or Firm* — Knobbe, Martens, Olson & Bear, LLP

(57) ABSTRACT

Various collapsible sun shelters are disclosed. In some embodiments, the sun shelter includes a frame structure. The frame structure can have a substantially longitudinal ridge beam, a first multi-axis hinge device, and/or a second multi-axis hinge device. The frame structure can have a plurality of support elements, such as first and second leg members. In some implementations, the frame structure includes a third leg member and a fourth leg member. In various embodiments, a shelter device includes a plurality of flexible shelter members, such as sails. The sun shelter can be configured to move between a collapsed state (e.g., for transport) and an expanded state (e.g., for use as a shelter against sun, wind, precipitation, etc.).

28 Claims, 12 Drawing Sheets

(56) References Cited

U.S. PATENT DOCUMENTS

| | | | | | |
|---|---|---|---|---|---|
| 4,285,355 | A | * | 8/1981 | Lundblade | E04H 15/42 135/147 |
| D264,613 | S | | 5/1982 | Moss | |
| 4,719,934 | A | | 1/1988 | Mydans | |
| 4,825,604 | A | | 5/1989 | Manning | |
| D326,134 | S | | 5/1992 | Norman | |
| 5,167,246 | A | * | 12/1992 | Mortenson | E04H 15/48 135/143 |
| D347,875 | S | | 6/1994 | Dalland | |
| 5,437,128 | A | | 8/1995 | Gremillion | |
| 5,511,572 | A | | 4/1996 | Carter | |
| 5,606,986 | A | | 3/1997 | Muise | |
| 5,709,238 | A | | 1/1998 | Mattioli | |
| 5,752,537 | A | * | 5/1998 | Kranzler | E04H 15/003 135/117 |
| 5,850,715 | A | | 12/1998 | Francis | |
| 6,085,768 | A | | 7/2000 | Arlotta | |
| 6,173,725 | B1 | | 1/2001 | Garth | |
| D438,589 | S | | 3/2001 | Brown | |
| 6,374,842 | B1 | | 4/2002 | Carter | |
| 6,418,577 | B1 | | 7/2002 | Murphy | |
| 6,712,083 | B2 | | 3/2004 | Carter | |
| 6,796,320 | B2 | | 9/2004 | Carter | |
| 6,994,099 | B2 | | 2/2006 | Goldwitz | |
| 7,406,977 | B1 | | 8/2008 | Shires | |
| D594,080 | S | | 6/2009 | Flem | |
| 7,584,763 | B2 | * | 9/2009 | Yoon | E04H 15/52 135/131 |
| D605,308 | S | | 12/2009 | Combs | |
| 7,740,022 | B2 | | 6/2010 | Li | |
| 7,793,674 | B2 | | 9/2010 | Elder | |
| 7,891,369 | B2 | | 2/2011 | Carter | |
| 8,056,573 | B2 | * | 11/2011 | Panigot | E04H 15/48 135/144 |
| 8,065,762 | B1 | | 11/2011 | Ewing | |
| 8,205,569 | B2 | | 6/2012 | Francis | |
| D689,157 | S | | 9/2013 | Lucero | |
| 8,567,423 | B1 | | 10/2013 | Combs, Jr. | |
| 8,616,226 | B2 | | 12/2013 | Ma et al. | |
| 2007/0079442 | A1 | | 4/2007 | Stoll | |
| 2012/0152293 | A1 | | 6/2012 | Lucero | |

* cited by examiner

COLLAPSIBLE SUN SHELTER

CROSS-REFERENCE

This application claims the priority benefit under 35 U.S.C. §119(e) of U.S. Provisional Application No. 61/968,503, filed Mar. 21, 2014, the entirety of which is incorporated herein by reference. This application incorporates by reference U.S. Design patent application Ser. No. 29/521,250, filed Mar. 20, 2015, titled "SUN SHELTER."

FIELD

This disclosure generally relates to recreational equipment and more particularly to a sun-shade structure.

BACKGROUND

Certain portable structures, which can be called "pop-up" tents, include fabric that is supported by one or more poles to form a canopy. Certain such structures include cords or loops that connect the fabric to pegs driven into the ground, thereby aiding in stretching and/or tightening the fabric. Some portable structures can be collapsed for transportation and storage.

SUMMARY OF CERTAIN EMBODIMENTS

In some embodiments, a shelter device includes a frame structure. The frame structure can have a substantially longitudinal ridge beam. In some embodiments, the ridge beam has a first multi-axis hinge device and a second multi-axis hinge device. In some variants, the first multi-axis hinge device is positioned adjacent to (e.g., at or near) a first end of the ridge beam and the second multi-axis hinge device is positioned adjacent to a second end of the ridge beam. The ridge beam can include a locking ridge hinge device. In some implementations, the locking ridge hinge device is between (e.g., adjacent to a midpoint between) the first and second multi-axis hinge devices.

The frame structure can have a plurality of support elements, such as leg members. For example, the frame structure can have a first leg member and a second leg member. The leg members can be configured to provide structural support for other components of the shelter device. The first and second leg members can be joined to one another and/or to the first end of the ridge beam, such as by the first multi-axis hinge device.

The first multi-axis hinge device can include a first pivot axis. The first pivot axis can be generally parallel to the ridge beam. The first and second leg members can be configured to move (e.g., pivot) about and/or along the first pivot axis, such as relative to one another and/or relative to the ridge beam. In some implementations, the first multi-axis hinge device has a second pivot axis. The second pivot axis can be generally perpendicular to the ridge beam. The ridge beam can be configured to move (e.g., slide or pivot) relative to the first and second leg members about and/or along the second pivot axis.

In certain embodiments, each of the first and second leg members has a foot portion and/or a locking leg hinge mechanism. The foot portion can be positioned at an end distal from the first multi-axis hinge device. The locking leg hinge mechanism can be positioned between the first multi-axis hinge device and the foot portion.

In some implementations, the frame structure includes a third leg member and a fourth leg member. The third and fourth leg members can be attached to the second multi-axis hinge device. In certain embodiments, each of the third and fourth leg members has a foot portion and/or a locking leg hinge mechanism.

In various embodiments, a shelter device includes a plurality of flexible shelter members, such as sails (e.g., sheets, tarpaulins, covers, panes, shields, or otherwise). In certain implementations, the sails are configured to block some or all light, wind, and/or precipitation from passing through the sails. For example, each sail can be a textile that is configured (e.g., woven and/or treated) to inhibit or prevent at least about 50% of the light, wind, and/or precipitation from passing through the sail. Some embodiments have a first upper sail, such as a sail extending between the first leg member and the third leg member. Some embodiments have a first lower sail, such as a sail extending between the first leg member and the third leg member. In certain implementations, the shelter device includes a second upper sail, such as a sail extending between the second leg member and the fourth leg member. Some variants have a second lower sail, such as a sail extending between the second leg member and the fourth leg member.

In certain embodiments, the shelter device includes a first sail riser. The first sail riser can be attached to the first leg member, such as adjacent to the locking leg hinge mechanism of the first leg member. The first sail riser can be configured to extend generally upwards (e.g., generally vertically) from the first leg member. In some embodiments, a portion of the first upper sail and/or a portion of the first lower sail are attached to an upper portion of the first sail riser, such as via attachment points on the first upper and/or lower sails. In some embodiments, the first sail riser is configured to move (e.g., pivot and/or slide) relative to the first leg member. In some variants, the first sail riser is pivotable about an axis, such as an axis that is collinear with a pivot axis of the locking leg hinge mechanism of the first leg member.

In some implementations, the locking ridge hinge device is similar to the locking leg hinge mechanisms. For example, the locking ridge hinge device can be structurally identical to the locking leg hinge mechanisms of the first and second leg members.

In certain embodiments, one, some, or each of the first upper sail, the first lower sail, the second upper sail, and the second lower sail is made of a stretchable material and/or is attached to the frame in a stretched configuration with a greater surface area than a relaxed configuration. In some variants, one, some, or each of the first upper sail, the first lower sail, the second upper sail, and the second lower sail has a dimension that is between 10% and 100% greater in the stretched configuration than in the relaxed configuration of each sail. In certain implementations, one, some, or each of the first upper sail, the first lower sail, the second upper sail, and the second lower sail is made of a fabric. The fabric can have a maximum elongation percent that is at least 10% greater than a percent difference between the relaxed configuration and the stretched configuration.

In some embodiments, the foot portion of each of the first and second leg members comprises a ground engagement feature, such as a cleat structure. The cleat structure can extend outward of and/or at an angle relative to the respective first and second leg member. In some embodiments, the cleat structure extends at an angle of approximately of at least 20 degrees and/or less than or equal to 70 degrees (e.g., approximately 45 degrees) from the respective leg member.

In various implementations, the first and second leg members are elongate structures. For example, in some embodiments, the first and second leg members can have a longitudinal length at least about 10 times greater than their width and/or height. The first leg member and the second leg member can be curved, such as with a concave shape. In some variants, the curve has a radius of curvature of at least about 5 feet, at least about 10 feet, or more. In some implementations, the first leg member and the second leg member have a concave surface that faces downwards (e.g., generally toward the ground) when the shelter device is an un-folded configuration and/or the foot portions are engaged with the ground.

In some embodiments, the shelter device includes a bracing member, such as a first diagonal support member. The first diagonal support member can extend between the ridge beam and the first leg. In certain implementations, the first diagonal support member is removably attached to attachment points on the ridge beam and/or the first leg member. In some variants, the first diagonal support member comprises a locking hinge. In some embodiments, the first diagonal support member is movable (e.g., pivotable and/or slidable) between a supporting position and a storage position. Some embodiments are configured such that, when the first diagonal support member is in the supporting position, the first diagonal support member is removably attached to attachment points on both the ridge beam and/or the first leg member. Certain embodiments are configured such that, when the first diagonal support member is in the storage position, the diagonal support member is positioned and/or supported in a position that is generally parallel to the ridge beam or the first leg member.

In certain implementations, the shelter device includes comprising a holder, such as a sunscreen holder. The holder can include a retaining structure (e.g., a cage) that is attached (e.g., pivotally) to one of the leg members, such as the first leg member. The holder can be biased upwardly by a biasing device, such as a spring, elastic cord, or otherwise. In some embodiments, the holder is being sized and configured to support and/or retain a flexible bottle (e.g., sunscreen bottle) against a lower surface of the first leg member.

In various embodiments, some or all of the sails are independent of (e.g., not directly connected to) the other sails. For example, the first upper sail can be independent of the first lower sail. In several embodiments the first upper sail can move independently from the first lower sail. For example, the shelter device can be configured such that substantially no movement of the first lower sail is transferred to the first upper sail. In some embodiments, the sails are not connected to each other.

In some implementations, the upper sail has a bottom edge. In certain variants, the bottom edge is about midway between the ridge beam and the foot portions of the first and third leg members. The bottom edge can be arcuate in shape, such as including one or more arc shapes. In some embodiments, the lower sail has a top edge. In some variants, the top edge is closer to the ridge beam than the lower edge of the first upper sail. The top edge can be arcuate in shape, such as including one or more arc shapes.

Neither the preceding summary, nor the following detailed description, nor the associated drawings limit or define the scope of protection. The scope of protection is defined by the claims.

BRIEF DESCRIPTION OF THE DRAWINGS

Certain novel features are set forth with particularity in the claims that follow. A further understanding of some of the features and advantages of some embodiments will be obtained by reference to the following detailed description that sets forth illustrative embodiments, in which certain non-limiting principles are utilized, and the accompanying drawings of which:

DETAILED DESCRIPTION OF CERTAIN EMBODIMENTS

Figure 1:
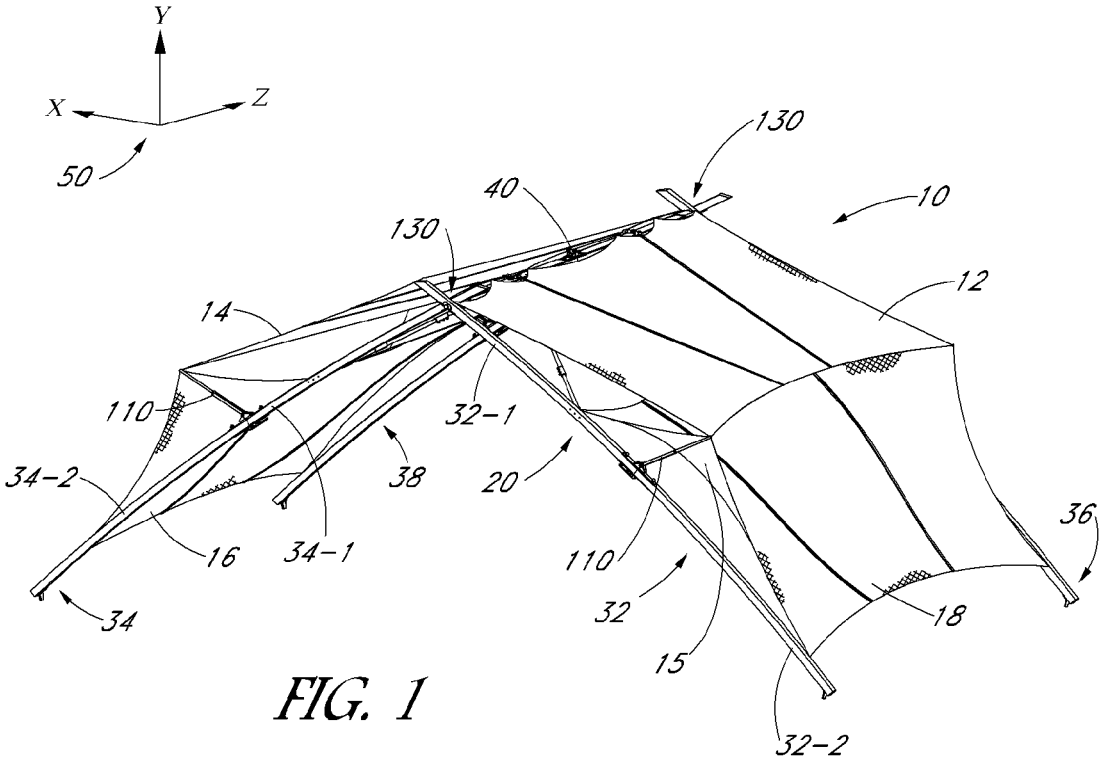
FIG. 1 is a top-side perspective view illustration of an example sun shelter.

The various embodiments will be described in detail with reference to the accompanying drawings. References made to particular examples and implementations are for illustrative purposes, and are not intended to limit the scope of the disclosure or the claims. Various features of the different disclosed embodiments can be combined to form further embodiments, which are part of this disclosure.

Various embodiments of a shelter structure are shown and described herein. In certain embodiments, the shelter may be configured to be foldable and/or collapsible. In some cases, the shelter may generally comprise a frame supporting multiple fabric "sails." The sails may be configured and positioned relative to the frame so as to provide sun and precipitation (e.g., light rain) protection to occupants of the shelter, to allow for free air-flow through the shelter, and/or to provide high visibility from inside the shelter to outside. In some embodiments, the frame may be configured to fold and/or collapse so as to facilitate transportation of the shelter. In some embodiments, such folding may be facilitated by unique hinge configurations. Other features and accessories may be attached to or otherwise incorporated into the shelter.

Shelters, such as some of those described herein, may generally be used to provide shade, comfort and storage at beaches or other outdoor setting. Children may also use versions of a shelter indoors as toys. Scaled down versions of the shelter may also be used as dog houses or other pet shelters.

FIG. 1 through FIG. 4 illustrate embodiments of a shelter 10 having certain advantageous features and configurations. Certain variants include some, but not all, of the features and configurations and/or different features and configurations. As shown, a plurality of sails 12, 14, 16, 18 may be supported (e.g., in tension) on a frame 20. The frame 20 can be rigid and/or configured to be foldable. As illustrated, the frame 20 may be generally A-frame shaped. For example, the frame 20 may include a pair of front leg members 32, 34 and a pair of rear leg members 36, 38. The legs of each pair may intersect one another near a peak of the shelter 10. A ridge-spanning spine member 40 may join the first pair of leg members 32, 34 to the second pair of leg members 36, 38. Sail risers 110 may be provided to support portions of upper sails 12, 14 and/or lower sails 16, 18 above the leg members, thereby forming raised sections 15 in the lower sails 16, 18 adjacent to the sail risers 110.

The frame 20 may have various hinge points allowing the shelter 10 to be collapsed and folded, such as for transportation. In some embodiments, each sail 12, 14, 16, 18 may be configured to flex independently of the other sails, and/or may be separately attached to the frame 20.

In some embodiments, substantially all of the structural and functional components of the shelter 10 may be attached to the frame 20 in such a way as to allow the shelter 10 to be collapsed without the need to remove any parts. This can substantially reduce or avoid the opportunity for removable parts to be lost between uses of the shelter 10.

Figure 3:
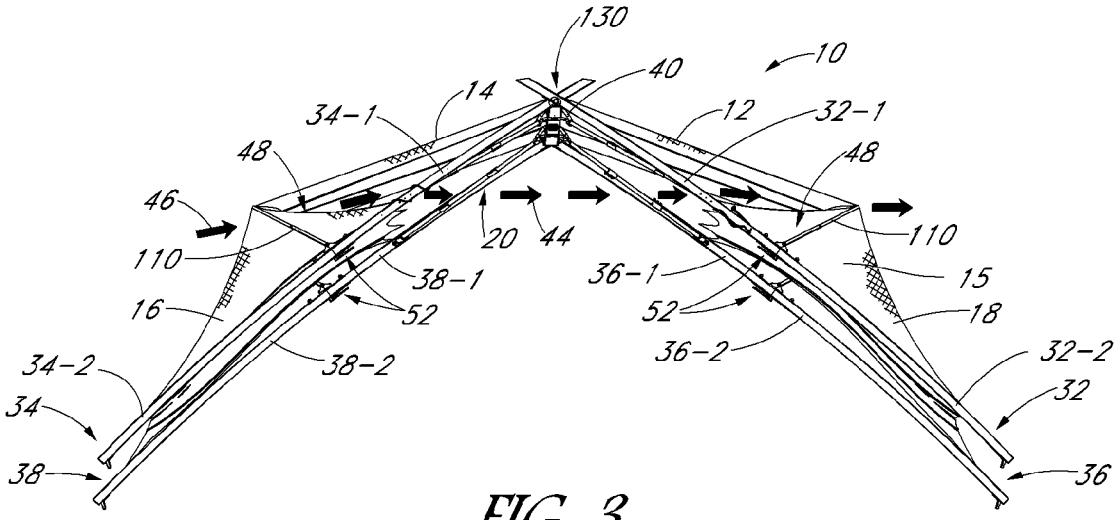
FIG. 3 is a front perspective view illustration of an example sun shelter showing wind-flow through the shelter.
Figure 4:
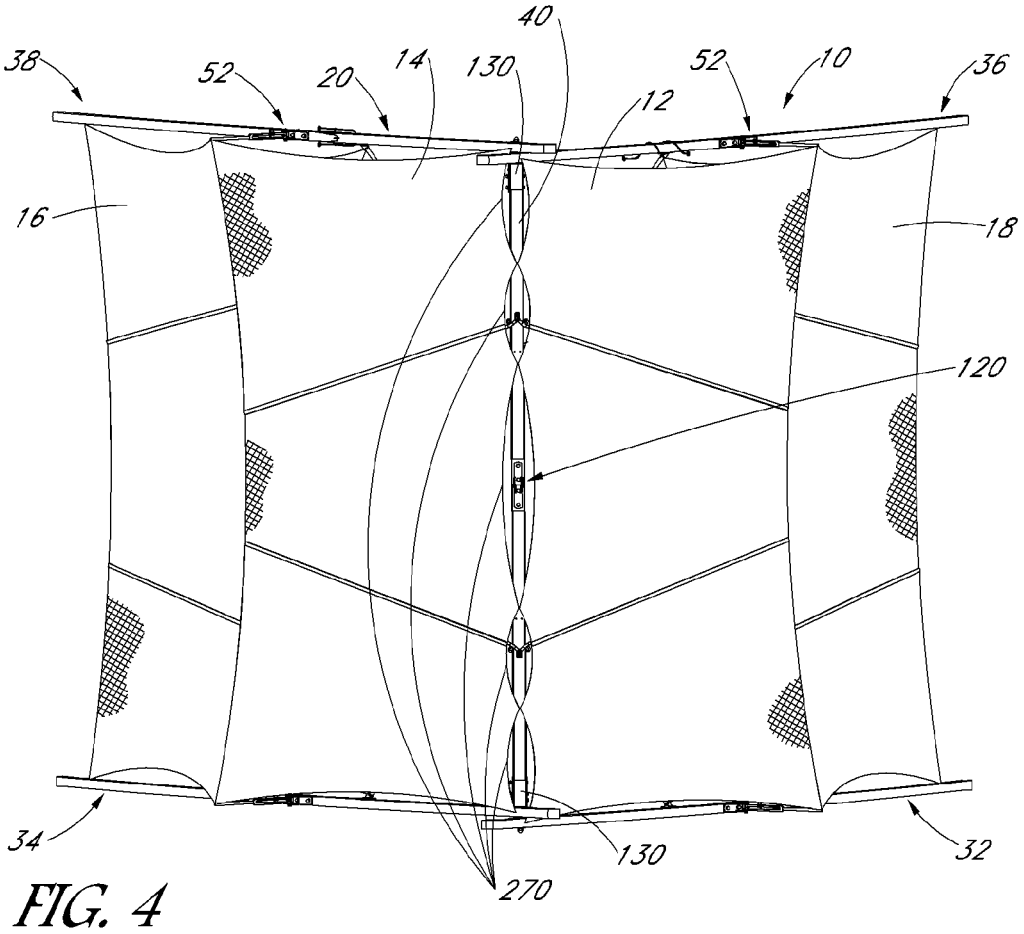
FIG. 4 is a top plan view illustration of an example sun shelter.

FIG. 3 illustrates an example of a cross-wind 44 flowing through the shelter 10. As can be seen, in some embodiments, the shape and orientation of the sails on the wind-inflow side 46 directs air slightly upwards, such as at least about 10° relative to horizontal, although the actual angles of wind flow through the shelter are likely to be affected by multiple factors such as the wind itself, the orientation of the shelter relative to the wind, the angle of the shelter legs, etc. In some embodiments, the shelter 10 is configured to allow the cross-wind 44 to flow through (e.g., laterally and/or longitudinally) and out of the shelter 10. Thus, in some embodiments the shelter 10 may advantageously be configured so as to reduce or avoid a requirement for stakes to hold the shelter 10 in place in a strong breeze. For example, the weight of the shelter 10 can exceed the lift created by air flowing through the shelter in a strong breeze. In some embodiments, the shelter 10 may be configured such that no substantial vertical lift is created by cross-wind 44 in the sails 12, 14, 16, 18 and/or a generally longitudinal wind. Certain embodiments may be configured such that the shelter 10 not need not be anchored to the ground by stakes. In some embodiments, because the sails 12, 14, 16, 18 channel air flow through the shelter 10, the interior of the shelter 10 may tend to remain at a comfortable temperature, such as by inhibiting or preventing heat build-up inside the shelter 10.

In some embodiments, the shelter 10 is configured to be pressed into engagement (e.g., downward and/or toward the ground) by the wind (e.g., the cross wind 44). In certain variants, the shelter 10 can be configured to transfer a wind force acting on the shelter to the ground via one or more of the sails 12, 14, 16, 18 and/or one or more of the leg members 32, 34, 36, 38. For example, a wind force acting on the sail 16 can be transferred to one or more of the leg members 32, 34, 36, 38, which in turn can transfer the wind force to the ground. In some embodiments, transfer of the wind force to the ground provides a grasping force that aids in securing the shelter 10 to the ground. In some implementations, the grasping force is related (e.g., linearly, exponentially, or otherwise) to the wind force. For example, in some embodiments, the grasping force increases as the wind force increases. In some embodiments, the legs members 32, 34 and/or the leg members 36, 38 move (e.g., splay) apart from each other in response to the wind force being applied to the shelter 10.

In some embodiments the shelter 10 may be sized and configured such that a gap 48 between the upper sail 14 and the lower sail 16 (or upper sail 12 and lower sail 18) on each side may be positioned approximately at a height allowing an occupant to see through the gap, thereby gaining additional visibility of the surroundings. The sails 12, 14, 16, 18 and frame 20 may be sized and configured such that the sails 12, 14, 16, 18 substantially block all or most sun at mid-day incident angles and/or all or most precipitation (e.g., light rain).

Sail Construction

As shown in FIG. 1-FIG. 4, upper 12, 14 and lower 16, 18 sails may be attached to a shelter frame 20 at various attachment points. Each sail 12, 14, 16, 18 may be stretched in tension between fabric connection points on the frame 20. In various embodiments, the sails 12, 14, 16, 18 may be configured with advantageous features to facilitate simple use, substantial wind resistance, open airflow through the shelter, ample sun protection, and/or rain protection.

In some embodiments, each sail 12, 14, 16, 18 may be made of a four-way stretch fabric capable of significant elongation along any direction. Such a four-way stretching fabric provides the advantage that each sail may absorb most of the energy of high winds, allowing remaining breezes to flow through the inside of the shelter.

In various embodiments, suitable four-way stretch fabrics may have an elongation percent of from about 10% to about 100% or more. In some particular embodiments, sails may be made of a four-way stretch fabric with an elongation percent of at least 25%, and in some embodiments a sail fabric elongation percent may be about 50% along one or two stretch axes. Elongation percent is an approximate maximum increase in length along an axis of maximum stretch-ability as a percent of un-stretched length and may be calculated by dividing a measured length increase by an un-stretched length and multiplying the result by 100.

Sail fabrics may be selected based on beneficial properties, such as minimal or zero shrinkage as a result of wetting or washing, durability, resistance to mold and/or insects, etc. Fabrics suitable for a shelter sail 12, 14, 16, 18 may include polyester fabrics, waterproof laminate fabrics (such as polyurethane laminate fabrics, waxed cotton, nylon spandex blends, polyester-spandex blends), or other fabrics. In some embodiments, a suitable spandex blend fabric may have approximately 85% nylon and/or polyester fibers and about 15% spandex fibers. In some embodiments, sail fabrics may include a higher or lower percent of spandex fibers, and may include other fibers. Alternatively, any other four-way stretch fabric may be used.

In some embodiments, the shelter sails 12, 14, 16, 18 may be made of a two-way stretch fabric that is capable of significant elongation along only a single axis (e.g., a bias axis or another stretch axis), or non-stretching material that is not capable of significant elongation in any direction. In some embodiments, the "non-stretch" materials may exhibit a small amount of stretchability. For example, a "non-stretch" material (or a two-way stretch material along a "non-stretch" axis) may have an elongation percent of up to a few percent, perhaps as high as about 5%.

In various embodiments, the shelter sail fabric may be UV stabilized and/or may include a coating of a hydrophobic material, such as silicone, polyurethane, wax, or other suitable waterproofing material.

Each sail may comprise one, two or more layers of fabric (e.g., an outer layer and an inner lining) as desired. The sail fabric and any lining fabric may be any color as desired.

Figure 5A:
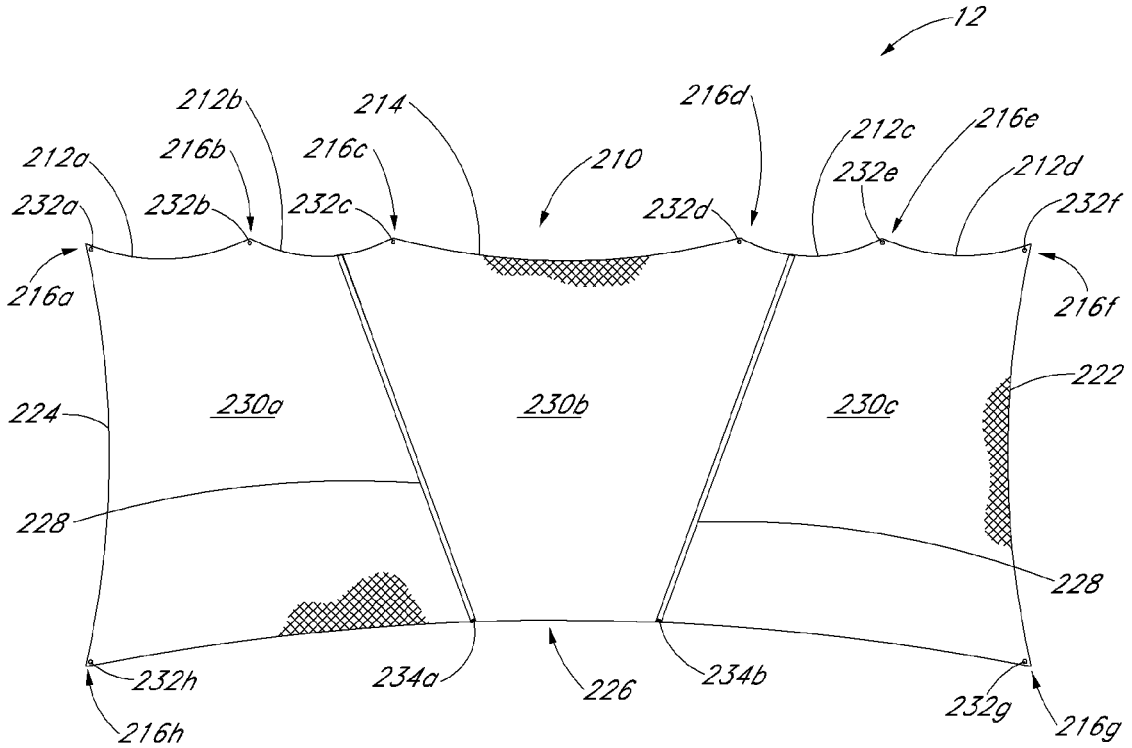
FIG. 5A is an elevation view illustration of a stretched upper sail element of an example sun shelter.

The upper sail 12 may have a shape in a stretched configuration (e.g., as installed on a frame 20) as shown in FIG. 5A. In a stretched configuration, an upper sail 12 may comprise a top edge 210 with a plurality (e.g., two, three, four, five, six, or otherwise) of side scallops 212*a*, 212*b*, 212*c*, 212*d*. Some embodiments may have a central scallop 214. In some embodiments, the central scallop 214 is larger (e.g., longer in arc length) than each of the side scallops 212*a*, 212*b*, 212*c*, 212*d* individually and/or collectively. As shown, the upper sail 12 can include points 216*a*-216*f* separating the scallops 212*a*, 212*b*, 214, 212*c*, 212*d*. The side edges 222, 224 of the upper sail 12, may have generally concave curved shapes. The bottom edge 226 of the upper sail 12 may comprise a concave curved shape.

The upper sail 12 may include seams 228. As shown, in some embodiments, the seams 228 may be along diagonal lines extending from the inner smaller scallops 212*b*, 212*c* at the top edge 210 to the bottom edge 226. The seams 228 may comprise ribbon, binding tape, bias tape, or other fabrics sewn onto a continuous fabric sail. Alternatively, the seams 228 may join at least three fabric pieces 230*a*, 230*b*, 230*c* to form a complete upper sail 12. In some embodiments, each of the sails may be made from a single continuous piece of fabric.

Some or all of the edges 210, 222, 226, 224 of the upper sail 12 may be sewn into a hem, bound with a binding tape, or otherwise bound to inhibit or prevent tearing or fraying. Any hem binding tape material may have similar stretch capabilities as the sail fabric.

The upper sail 12 may include a plurality of attachment points 232*a*-232*h*. The attachment points 232*a*-232*h* may be configured to facilitate attachment of the sail 12 to the frame 20. Sail attachment structures on the upper sail 12 may include snaps, button-holes, holes, slits, embroidered holes or slits, grommets, clips, or others. Alternatively, the upper sail 12 may not include any particular attachment structures. For example, if the upper sail 12 is to be attached by clamps or other fabric-pinching structures, then the upper sail 12 may not require any attachment structures.

Upper sail attachment points 232*a*-232*h* may be provided adjacent each point 216*a*-216*h* of the sail shape. The top corner attachment points 232*a*, 232*f* may be configured to attach to points on the frame adjacent the upper ends of leg members 32, 34, 36, 38, or to the ridge spine 40 (FIG. 1). The remaining top-edge attachment points 232*b*, 232*c*, 232*d*, 232*e* may be configured to be secured to the ridge spine, or to an opposite upper sail 14 (FIG. 1). Further or fewer top-edge attachment points in comparison to those shown may be included.

Attachment points 232*g*, 232*h*, which can be located at the bottom corners 216*g*, 216*h* of the upper sail 12, may be provided. The attachment points 232*g*, 232*h* can be configured to facilitate attachment of those points to the sail riser 110 and/or to attach with one or more guy-lines (e.g., cords of stretchable or substantially non-stretchable material, such as a nylon rope). In some embodiments, guy-line attachment points 234*a*, 234*b* may be provided along the lower edge 226 of the upper sail 12. In some embodiments, guy line cords may be attached between the guy-line attachment points 234*a*, 234*b* and attachment structures adjacent the bottom end of one or both of the leg members 32, 34, 36, 38. In some embodiments, guy-line attachment points may be provided at one or more points along seams 228. In some embodiments, guy line cords may be attached to stakes or other anchors set in the ground adjacent the structure 10. In some embodiments, any number of attachment points and/or guy lines may be used to secure the upper sail 12 to the frame 20 or to other structures.

Figure 6A:
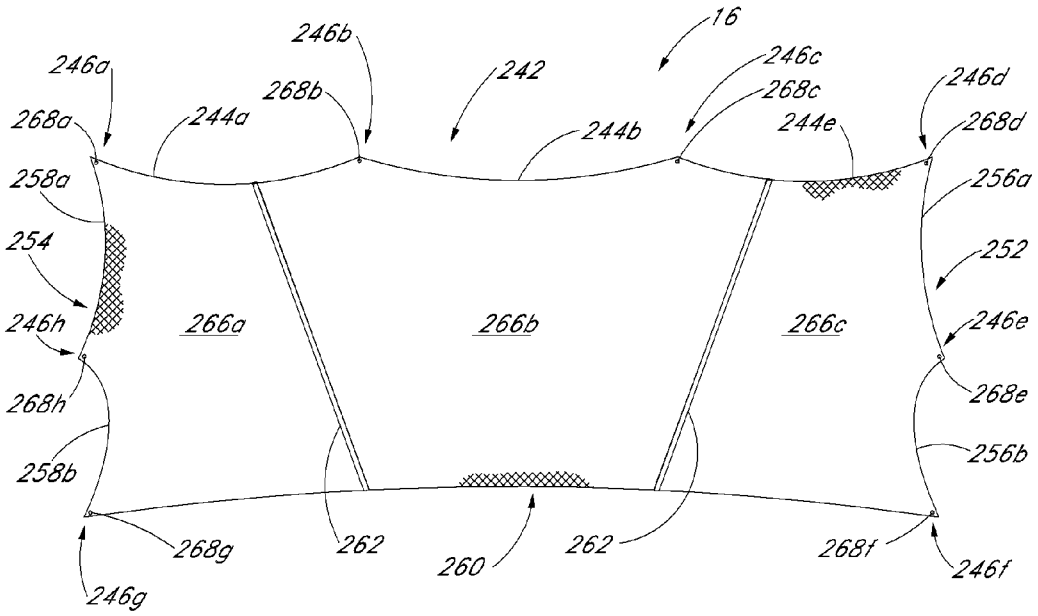
FIG. 6A is an elevation view illustration of a stretched lower sail element of an example sun shelter.

The lower sail 16 may have a shape in a stretched (installed) configuration as shown in FIG. 6A. In a stretched configuration, a lower sail 16 may comprise a top edge 242 with a plurality (e.g., two, three, four, or more) of concave scallops 244*a*, 244*b*, 244*c*. As illustrated, the scallops 244*a*, 244*b*, 244*c* can be separated by points 246*a*, 246*b*, 246*c*, 246*d*. The side edges 252, 254 of the lower sail 16, may have two concave scallops 256*a*, 256*b*, 258*a*, 258*b* separated by points 246*d*, 246*e*, 246*f* and 246*a*, 246*h*, 246*g*, respectively. The bottom edge 260 of the lower sail 16 may comprise a continuous concave curved shape.

The lower sail 16 may include seams 262. As shown, the seams 262 can extend along diagonal lines extending from the outer scallops 244*a*, 244*e* at the top edge 242 to the bottom edge 260. The seams 262 may comprise ribbon, binding tape, bias tape, or other fabrics sewn onto a continuous fabric sail. Alternatively, the seams 262 may join at least three fabric pieces 266*a*, 266*b*, 266*c* to form a complete lower sail 16.

Some or all of the edges 242, 252, 254, 260 of the lower sail 16 may be sewn into a hem, bound with a binding tape, or otherwise bound to inhibit or prevent tearing or fraying. Any hem binding tape material may have similar stretch capabilities as the sail fabric.

The lower sail 16 may include a plurality of attachment points 246*a*-246*h*. The attachment points 246*a*-246*h* can be configured to facilitate attachment of the lower sail 16 to the frame 20. Sail attachment structures on the lower sail 16 may include snaps, button-holes, holes, slits, embroidered holes or slits, grommets, clips, or others. Alternatively, the lower sail 16 may not include any particular attachment structures. For example, if the lower sail 16 is to be attached by clamps or other fabric-pinching structures, then the lower sail 16 may not require any attachment structures.

Lower sail attachment points 268*a*-268*h* may be provided adjacent each point 246*a*-246*h* of the sail shape. The top corner attachment points 268*a*, 268*d* may be attached to upper sections 32-1, 34-1, 36-1, 38-1 of leg members 32, 34, 36, 38. In some embodiments, top corner attachment points 268*a*, 268*d* may be attached to the ridge spine 40 or to the upper sections 32-1, 34-1, 36-1, 38-1 of leg members 32, 34, 36, 38 by elongate cords. Central upper-edge attachment points 268*b*, 268*c* on the lower sail may be secured to the ridge spine or other structures, such as by cords extending from the attachment points 268*b*, 268*c* to attachment structures on the ridge spine 40 or other structures (e.g., diagonal cross support members as described below), or to an opposite top sail 14 or an opposite bottom sail 18 after passing over the ridge spine 40. Further or fewer lower sail top-edge attachment points in comparison to those shown may also be included.

Cords used in attaching sail portions to frame portions may include any suitable stretchable or non-stretchable cord, rope, cable, ribbon, etc. For example, in some embodiments, attachment cords may comprise stretchable or non-stretchable with a diameter of about 2 mm to about 8 mm. In some particular embodiments, an attachment cord may have a diameter of about 4 mm, 5 mm, 6 mm or 7 mm. In some embodiments, attachment cords may comprise stretchable shock cord or bungee cord. In some embodiments, attachment cords may comprise kernmantle rope or braided rope (e.g., single-braided rope, double-braided rope, or multi-braided rope). Such kernmantle or braided rope may be either static rope (e.g., designed to stretch minimally, such as an elongation percent of less than 10% or less than 5%) or dynamic rope (e.g., designed to stretch more than static rope, such as an elongation percent of up to about 30%). Attachment cords may be made of any suitable natural or manufactured fiber.

Attachment points 268*e* midway along the sides of the lower sail 268*h* may be attached to the sail risers 110, thereby supporting a section of the lower sail 16 at a different elevation than other sections of the lower sail 16. The raised section 15 of the lower sail 16 contiguous to the sail riser 110 may create a path for directing air flow through the shelter while shading the interior of the shelter from the sun. The raised section 15 also provides additional volume to the interior of the shelter 10.

Attachment points 268*f*, 268*g* at the bottom corners 246*f* of the lower sail 246*g* may be provided and configured to facilitate attachment of those points to the lower leg sections 32-2, 34-2, 36-2, 38-2. In some embodiments, guy-line attachment points may also be provided along the lower edge 260 of the lower sail 16. In some embodiments, guy line cords may be attached between the guy-line attachment points and attachment structures adjacent the bottom end of one or more of the leg members 32, 34, 36, 38. In some embodiments, guy-line attachment points may be provided at one or more points along seams 262. Alternatively, guy line cords may be attached to stakes or other anchors set in the ground adjacent the structure 10. In some embodiments, any number of attachment points and/or guy-lines may be used to secure the lower sail 16 to the frame 20 or to other structures. Guy-line points or other attachment points may also be provided at any other location on the upper or lower sails.

Each of the upper sails 12, 14 and the lower sails 16, 18 may have a shape in an un-stretched configuration substantially similar to the shapes shown in FIG. 5A and FIG. 6A, respectively. Alternatively, each of the upper sails 12, 14 and the lower sails 16, 18 may be substantially rectangular in an un-stretched shape, and the illustrated shape may be formed by stretching the sails between the various attachment points.

Figure 5B:
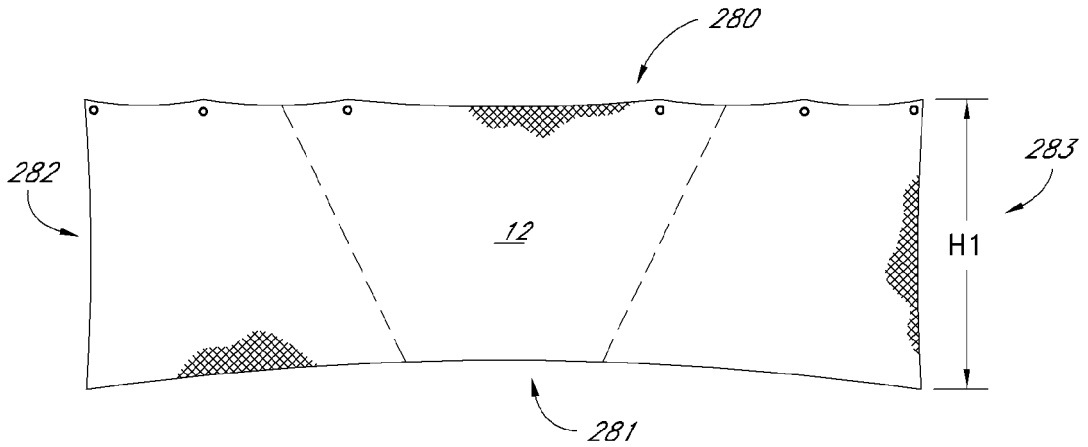
FIG. 5B is an elevation view illustration of an un-stretched upper sail element of an example sun shelter.

In some embodiments, upper sails 12, 14 may have an un-stretched shape, such as is shown in FIG. 5B. The upper sails 12, 14 may each have a top 280, a bottom 281, a first side 282, and a second side 283. As shown, the top 280 can include one or more recesses, such as concave and/or arcuate portions. The bottom 281 can include a recess, such as a generally continuous curve between the first and second sides 282, 283. In certain variants, the bottom is linear. In some implementations, the first and second sides 282, 283 are curved. In some embodiments, the first and second sides 282, 283 are linear. In some embodiments, the first and second sides 282, 283 are generally parallel. As illustrated, the upper sails 12, 14 may each have a height H1.

Figure 6B:
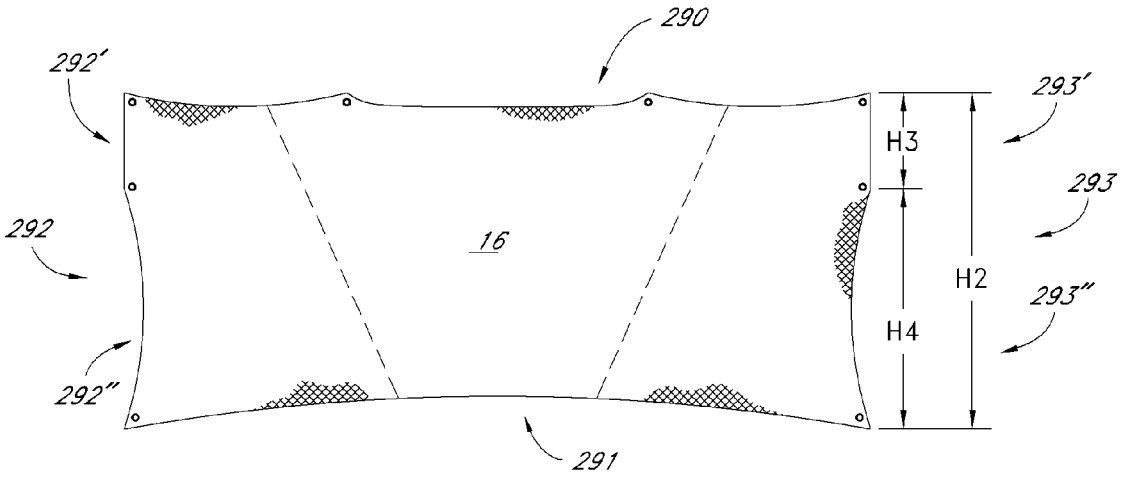
FIG. 6B is an elevation view illustration of an un-stretched lower sail element of an example sun shelter.

In some embodiments, the lower sails 16, 18 may have an un-stretched shape, such as is shown in FIG. 6B. The lower sails 16, 18 may each have a top 290, a bottom 291, a first side 292, and a second side 293. As shown, the top 290 can include one or more recesses, such as concave and/or arcuate portions. The bottom 291 can include a recess, such as a generally continuous curve between the first and second sides 292, 293. In certain variants, the bottom is linear. In some implementations, the first and second sides 292, 293 each include a plurality of portions. For example, the first side 292 can include a first portion 292' and a second portion 292" and the second side 293 can include a first portion 293' and a second portion 293".

In some embodiments, the location of the attachment points 268*e*, 268*h* may provide the boundary between the first and second portions of a side. As shown, in some implementations, the first portion 292' and/or 293' may be generally linear and the second portion 292" and/or 293" may be curved. In some embodiments, the first and second portions 292', 292" and/or 293', 293" are both linear or both curved. In some embodiments, the first portions 292', 293' are generally parallel.

As illustrated, the lower sails 16, 18 may each have a height H2. In some embodiments, the height H2 of the lower sails may be greater than the height H1 of the upper sails. For example, the ratio of H2 to H1 can be at least about: 1.1, 1.2, 1.3, 1.4, 1.5, 1.8, 2.0, ratios between the aforementioned ratios, or other ratios. As is also illustrated, the first portions 292', 293' may have a height H3 and the second portions 292", 293" may have a height H4. In some embodiments, the height H4 of the second portion may be greater than the height H3 of the first portion. For example, the ratio of H4 to H3 can be at least about: 1.5, 1.8, 2.0, 2.2, 2.4, 2.6, 3.0, ratios between the aforementioned ratios, or other ratios.

The shape of the upper edge 242 of the lower sail 16 and the lower edge 226 of the upper sail 12 may be configured to create a slit 48 (FIG. 3) approximately midway down the shelter. The slit 48 (FIG. 3) may provide advantages, such as increased visibility and/or wind flow as described above. The size of the slit 48 (FIG. 3) may be a function of the height of the sail risers 48 (FIG. 3). Taller sail risers may create a larger slit by changing the angle of the upper sail 12, 14 relative to the lower sail 16, 18 (e.g., relative to the lower-sail-plane, which is discussed below). For example, in some embodiments, the sail riser 110 may have a length of about six inches to about 18 inches. Portions of the upper and/or lower sails may be supported at a point along the length of the sail riser 110. In some embodiments, the sail riser 110 may have a length of about 12 inches. In some embodiments, the upper and/or lower sail may be attached to the sail riser 110 at a point approximately 12 inches from a hinge pivot axis. The sail riser 110 may produce a gap between the upper sail and the lower sail of about eight inches.

In an installed configuration as shown in FIG. 1, the top sails 12, 14 and the bottom sails 16, 18 may overlap in non-parallel planes. Each of the upper sails 12, 14 may substantially lie in a respective upper-sail-plane that is at a greater angle relative to a vertical plane passing through the ridge spine 40 than a plane of each of the lower sails 16, 18. Because portions of the lower sail may be supported by sail risers 110, the lower sails 16, 18 might not lie in a single plane. Nonetheless, a lower-sail-plane may be generally defined by the corner attachment points 232*a*, 232*f*, 232*g*, 232*h* of the lower sails 16, 18. In other words, the lower-sail-plane may be a planar orientation of the lower sail when the lower sail is detached from the sail risers 110.

For example, the upper-sail-plane may lie at an angle of between about 10 degrees and about 20 degrees relative to the lower-sail-plane. In some particular embodiments an angle between the upper-sail-plane and the lower-sail-plane may be between about 11 degrees and about 16 degrees, such as about 11 degrees, about 12 degrees, about 13 degrees, about 14 degrees, about 15 degrees or about 16 degrees.

The sail risers 110 and other frame attachment points may be configured such that the overlap and/or an angle between the upper-sail-plane and the lower-sail-plane inhibits and/or does not allow the sun to shine directly into the shelter 10 through the slit 48 (except perhaps when the sun's rays are substantially parallel to horizontal, such as at or near sunset). Similarly, the upper sails 12, 14 and the lower sails 16, 18 may be sized such that each upper sail 12, 14 overlaps a portion of the corresponding lower sail 16, 18. The size of the overlapping sail regions may affect visibility and air flow through the slits 48. The overlapping sail configuration may provide the advantage that, in a light rain, rain that drops down the side of the top sail may continue onto the bottom sail without entering the shelter. In some embodiments, portions of each upper sail 12, 14 may overlap portions of each lower sail 16, 18 by about six inches or less to about 18 inches or more.

In some embodiments, the upper sails 12, 14 may be configured to meet at the ridge spine 40 of the shelter in such a way to leave two, three, four or more open top slits 270. The top slits 270 may provide ventilation for air flow. In some embodiments, the top slits 270 may be configured to be partially or completely closed by buttons, zippers, hook-and-loop fasteners, or other structures so as to seal the ridge from sun and/or rain. In some embodiments, the two top sails 12, 14 may be attached (e.g., sewn) together along the ridge line of the shelter, or may be made from a single piece of fabric. In various embodiments, ridge openings 270 may be omitted entirely, or may be configured to be opened and closed as desired.

Frame Construction

Examples of the structure and construction of a shelter frame 20 and various component parts will now be described. Although the shelter frame 20 is described with reference to examples and illustrations, the skilled artisan will recognize that further variations are also possible. In some cases, the shape and orientation of elements of a shelter frame may be described with reference to the coordinates 50 illustrated in FIG. 1 in which the "front" opening of the shelter lies substantially in the X-Y plane, and the ridge spine 40 extends substantially parallel to the Z-axis. The skilled artisan will recognize that the chosen reference points are not intended to limit the scope of the disclosure, but are provided merely for convenience of explanation.

In some embodiments, the leg members 32, 34, 36, 38 may be made of wood, metal, plastics, composites, fiberglass, carbon fiber, fiber-plastic composites, or combinations of these. For example, in some embodiments, the leg members 32, 34, 36, 38 and/or the ridge spine member 40 may be made of laminated wood joined together with hinge mechanisms made of metal or plastic (e.g., cast, machined, and or 3D printed aluminum, plastic, or composite material). In some embodiments, the leg members 32, 34, 36, 38 and/or the ridge spine member 40 may be substantially entirely made of aluminum tubing. In some embodiments, the leg members 32, 34, 36, 38 and/or the ridge spine member 40 may be made of laminated fiberglass or any other laminated and/or composite materials to achieve desired mechanical properties and functions.

In some embodiments, some or each leg member 32, 34, 36, 38 may have a curvature in the X-Y plane (e.g., about an axis in the Z-direction). In some embodiments, each leg member 32, 34, 36, 38 may have a curvature in the X-Y plane with a radius of between about five feet and about 10 feet with a concave surface of the leg facing downwards and inwards towards the "front" or "rear" opening. Curvatures of greater or smaller radii may also be used. In some embodiments, one or more of the leg members may have a curvature defined by a maximum deviation from a straight line between end points of about six inches. In some embodiments, a maximum deviation from straight may be between zero inches and about eight inches or more. In some embodiments, each leg member 32, 34, 36, 38 may be configured to maintain a desired curvature in a free-standing self-supporting manner without being held in a curved position by another structure under tension. In some embodiments, each leg may be substantially straight.

Figure 7:
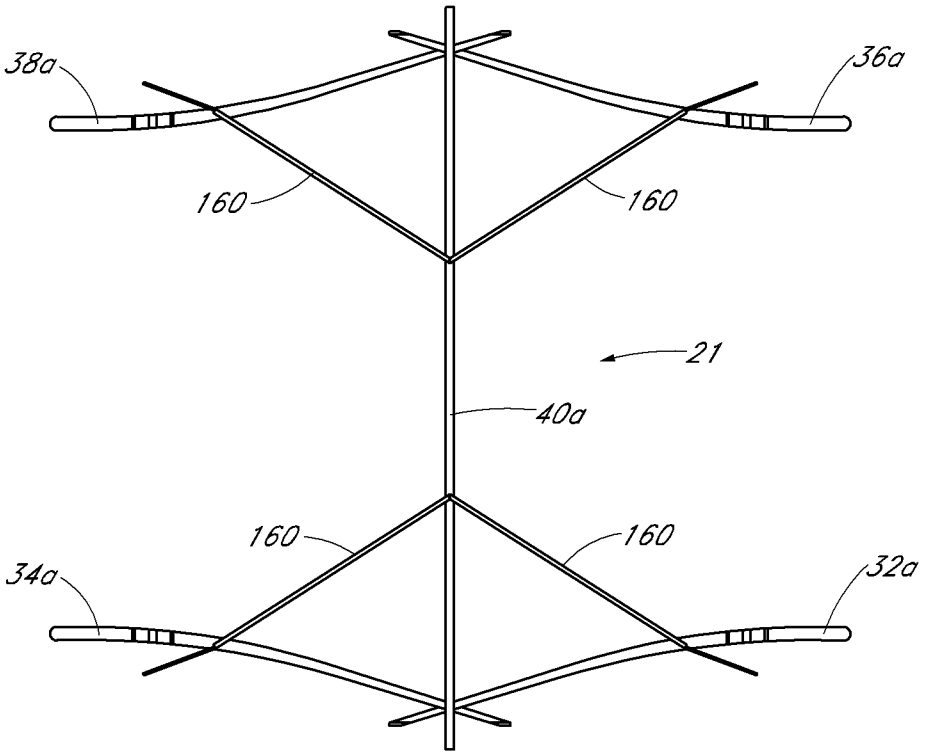
FIG. 7 is a top plan view illustration of an example sun shelter frame.

In some embodiments, some or each leg member 32, 34, 36, 38 may have a curvature in the X-Z plane (e.g., about an axis in the Y-direction or as viewed from directly above in a set-up position). In some embodiments, each leg member 32, 34, 36, 38 may have a curvature in the X-Z plane with a radius of between about five feet and about 10 feet with a concave surface of the leg facing away from the center of the shelter 10. In some embodiments, each leg member 32, 34, 36, 38 may be configured to maintain a desired curvature in a free-standing self-supporting manner without being held in a curved position by another structure under tension. FIG. 7 illustrates an example of a frame 21 in which leg members 32*a*, 34*a*, 36*a*, 38*a* have a substantial curvature in the X-Z plane. In some embodiments, each leg may be substantially straight.

Such a self-supporting curved leg may be made by laminating multiple layers of wood, metal, fiberglass or other material to one another while bending the leg member into a desired shape. Alternatively, other methods of manufacturing a curved leg member may also be used.

In some embodiments, each leg member 32, 34, 36, 38 may be divided into an upper segment 32-1, 34-1, 36-1, 38-1 and a lower segment 32-2, 34-2, 36-2, 38-2, respectively. The upper and lower segments can be pivotally joined together by a locking leg hinge mechanism 52. The locking leg hinge mechanism 52 can be located approximately halfway along the total length of the leg member 32, 34, 36, 38. Such an arrangement may allow the lower section 32-2, 34-2, 36-2, 38-2 of each leg member 32, 34, 36, 38 to be folded (e.g., upwards towards the ridge spine 40) about a leg hinge pivot axis substantially parallel to the Z-axis (in the orientation illustrated in FIG. 1). In some embodiments, the leg hinge 52 may include a locking mechanism to maintain the leg in a desired orientation without requiring additional support or tension members.

Figure 8:
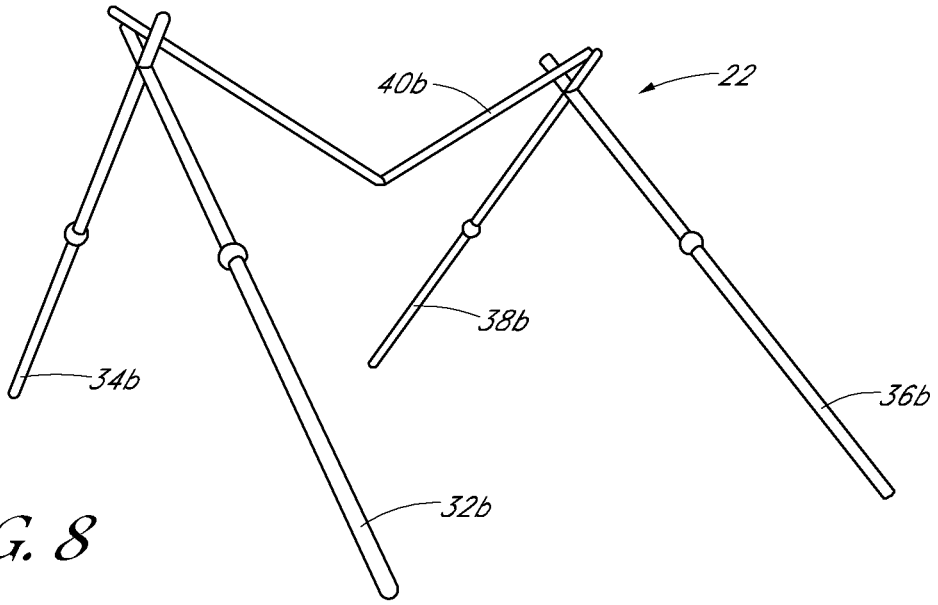
FIG. 8 is a perspective view illustration of an example sun shelter frame.

In some embodiments, the leg members 32*b*, 34*b*, 36*b*, 38*b* may comprise two or more independent and/or separable segments as shown, for example, in FIG. 8. In various embodiments, the upper and lower separable segments may be configured to connect together, such as the upper separable segment securely receiving the lower separable segment.

In some embodiments, the locking leg hinge mechanism 52 may be configured to support each upper leg segment 32-1, 34-1, 36-1, 38-1 at a desired angle relative to the corresponding lower leg segment 32-2, 34-2, 36-2, 38-2. For example, in some embodiments, each upper leg segment 32-1, 34-1, 36-1, 38-1 and each lower leg segment 32-2, 34-2, 36-2, 38-2 may be substantially straight and the leg hinge mechanism 52 may be configured to lock into a position in which the attached upper leg segment 32-1, 34-1, 36-1, 38-1 and corresponding lower leg segment form an angle of approximately 180 degrees. In some embodiments, each pair of upper and lower leg segments may form an angle of greater or less than 180 degrees in a locked orientation.

Figure 9:
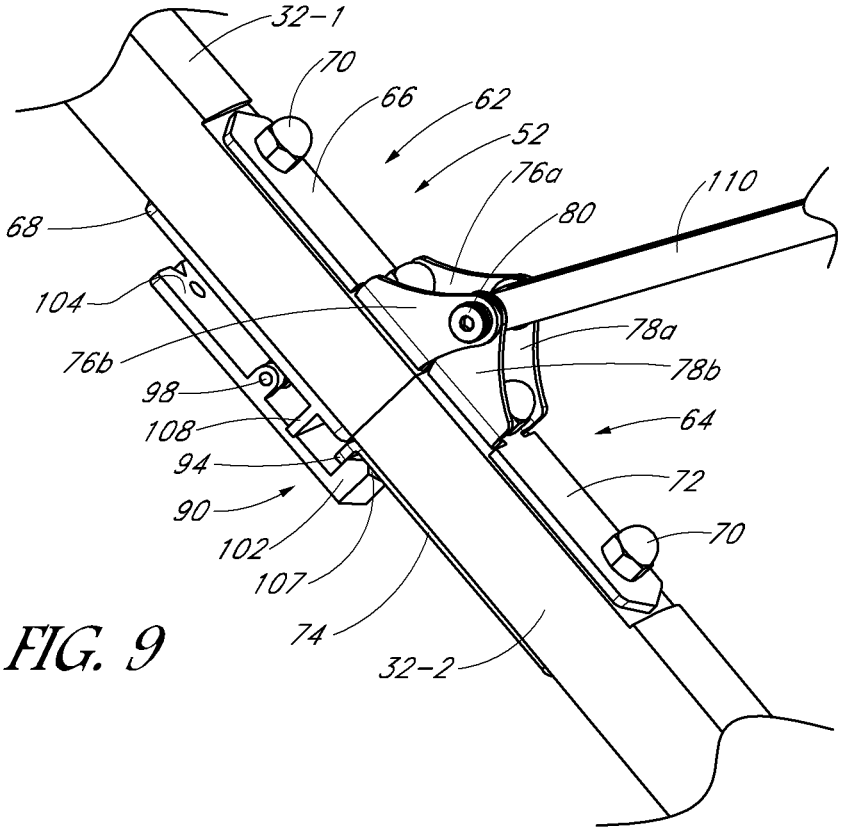
FIG. 9 is an upper perspective view illustration of an example leg hinge assembly.
Figure 10:
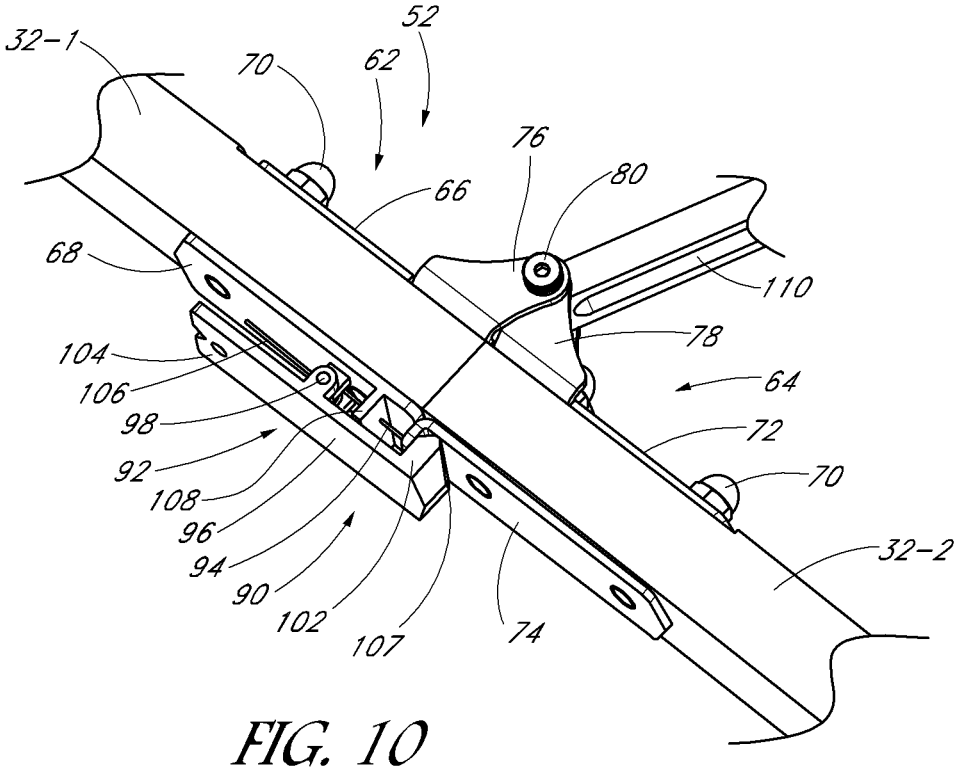
FIG. 10 is a lower perspective view illustration of an example leg hinge assembly.

FIG. 9 and FIG. 10 illustrate an example embodiment of a leg hinge mechanism 52 that may be used for joining an upper leg section 32-1 and a lower leg section 32-2. The hinge mechanism 52 may include an upper portion 62 and a lower portion 64. The upper hinge half 62 may include an upper leg section attachment portion comprising a first upper plate 66 and a first lower plate 68 on opposite surfaces of an upper leg section 32-1. The first upper plate 66 may be secured to the first lower plate 68 by two or more fasteners 70.

In some embodiments, a lower leg section attachment portion of the lower hinge half 64 may comprise an second upper plate 72 and a second lower plate 74 on opposite surfaces of a lower leg section 32-2. The second upper plate 72 may be secured to the second lower plate 74 by two or more fasteners 70. Fasteners 70 attaching plates to leg sections may comprise bolts, nuts, screws, rivets or other mechanical fasteners. Alternatively, the hinge plates may be attached to leg sections by adhesives, welds, or other fastening methods.

The first 66 and second 72 upper plates may include one or more hinge flanges 76*a*, 76*b*, 78*a*, 78*b* extending upwards from the upper plates 66, 72. The hinge flanges 76, 78 may be configured to receive one or more hinge pins 80 configured to secure the upper and lower hinge halves 62, 64 in a pivotable orientation relative to one another. The one or more hinge pins 80 may define a leg hinge pivot axis.

The leg hinge mechanism 52 may include a locking mechanism 90, such as is shown in FIG. 9 and FIG. 10. In the illustrated configuration, the locking mechanism 90 may comprise a latch mechanism 92 and a catch hook 94. In some embodiments, the latch mechanism 92 may be attached to a side (e.g., the under-side) of the upper leg section 32-1. In certain variants, the catch hook 94 may extend to the second lower plate 74 attached to the under-side of the lower leg section 32-2. In some embodiments, the latch mechanism 92 may be attached to the lower leg section 32-2 and the catch hook 94 may be attached to the upper leg section 32-1.

The latch mechanism 92 may comprise a latch plate 96 pivotally joined to the first lower plate 68, which can form a base plate 68. A pivot element (e.g., a pin 98) may be provided to pivotally attach the latch plate 96 to the base plate 68. The latch plate 96 may comprise a latch hook 102 extending at a substantially right angle relative to a back bar 204. A biasing member (e.g., a torsional spring 106) may be provided to bias the latch hook 102 towards a locked position as shown. The back bar 104 may include a lever arm extending away from the pivot 98 in a direction opposite the latch hook 102. The lever arm may be of a suitable length to allow sufficient rotation of the latch plate 96 to allow the latch hook 102 to open sufficiently to receive a catch hook 94. A longer lever arm may provide for easier opening of the latch, while too long of a lever arm may inhibit or prevent the latch hook 102 from opening sufficiently to receive the catch hook 94.

The latch hook 102 and/or the catch hook 94 may comprise an engaging portion, such as a sloped surface 107 configured to be engaged by the catch hook 94 as the leg sections 32-1, 32-2 are straightened towards a locked position. In some embodiments, as the leg sections are unfolded and/or straightened (e.g., brought into generally parallel and/or collinear alignment), the catch hook 94 may engage the sloped surface 106 of the latch hook 102, thereby opening the latch 92 and allowing the catch hook 94 to move towards a locked position (shown in FIG. 9). In some embodiments, near or after the leg sections 32-1, 32-2 are unfolded and/or straightened to a secured position (such as is illustrated in FIG. 10), the torsion spring 106 may cause the latch hook 102 to return to a locked position while capturing the catch hook 94. A holding flange 108 may be provided to retain the latch plate 96 in a suitable orientation for receiving the catch hook 94.

In some embodiments, the hinge mechanism 52 may be advantageously configured to place the upper leg section 32-1 in a position directly abutting the lower leg section 32-2 in an unfolded and locked position. This arrangement allows any load applied to one leg segment to be transferred directly to the other leg segment.

Alternatively, any other suitable locking hinge mechanism may be used to join a lower leg segment 32-2 to an upper leg segment 32-1 in a lockable and pivotable configuration relative to one another. For example, in some implementations the latch mechanism 92 includes a biased actuator (e.g., a push button) coupled with one or more biased elements, such as pins. Actuating the actuator can move the elements against the bias. In some implementations, when the actuator is not actuated the biased elements protrude from an upper surface of the latch mechanism 92, and when the actuator is actuated the biased elements are recessed below the upper surface of the latch mechanism 92. In some embodiments, the biased elements are configured to engage with receiving elements (e.g., recesses or holes) in the catch hook 94. For example, the biased elements can have sloped surfaces that facilitate movement of the biased elements into the receiving elements. In various embodiments, when the biased elements are received in the receiving elements, the leg hinge mechanism 52 is in a locked state, which can inhibit or prevent movement of the leg sections 32-1, 32-2 relative to each other. In some variants, when the actuator is actuated, the biased elements are moved out of engagement with the receiving elements, thereby placing the leg hinge mechanism 52 is in an unlocked state in which the leg sections 32-1, 32-2 can readily move relative to each other.

Figure 2:
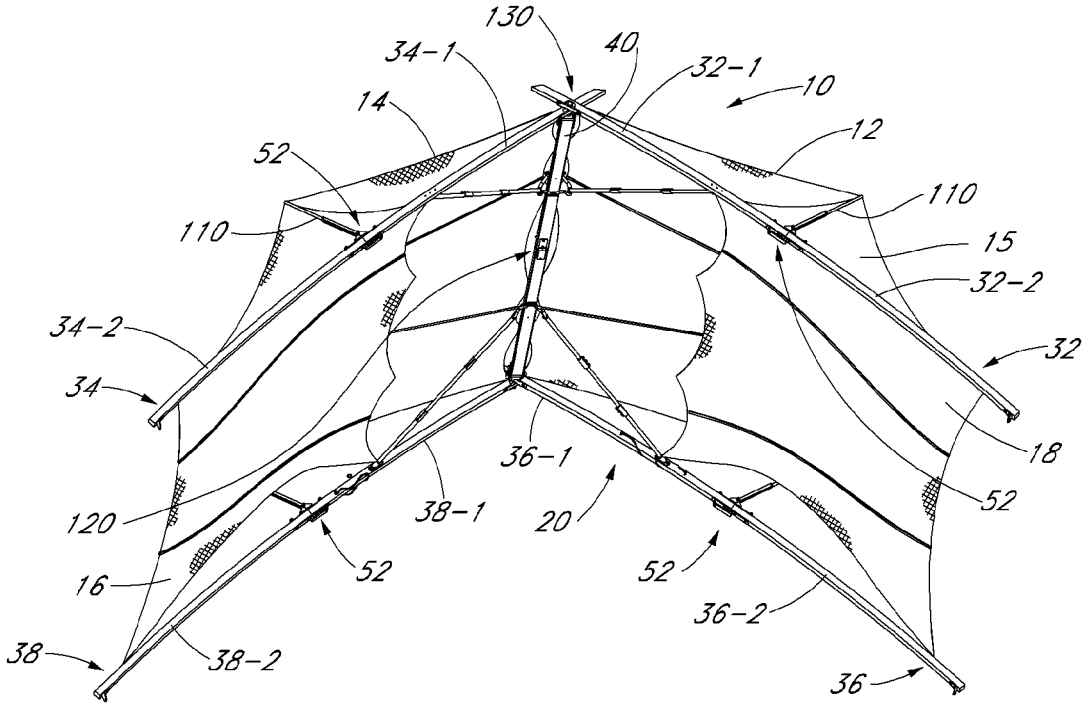
FIG. 2 is a bottom-side perspective view illustration of an example sun shelter.

As shown in FIG. 1, FIG. 2, and FIG. 3, it may be beneficial in some cases to support a portion of an upper sail 12, 14 and/or a lower sail 16, 18 at an attachment point above each leg member 32, 34, 36, 38. In some embodiments, a rigid sail riser member 110 may extend from each leg member 32, 34, 36, 38 from a region near a midpoint of the leg 32, 34, 36, 38. A sail riser 110 may include one or more sail attachment points and may comprise any suitably rigid member. A sail riser 110 may be pivotally or rigidly affixed to a leg hinge mechanism 52 or another portion of a leg member 32, 34, 36, 38.

In some embodiments, a sail riser 110 may be attached to a leg hinge mechanism 52 as shown in FIG. 9 and FIG. 10. A sail riser 110 may be made of any suitable material in any suitable shape to support an attached segment of a sail while also allowing for folding or collapsing of the shelter frame 20. The example sail riser 110 best seen in FIG. 13 may have a tuning-fork-shaped lower section 112 and a straight upper section 114. The upper section 114 may include one or more sail attachment mechanisms configured for removably securing a section of one or more of the sails.

Figure 13:
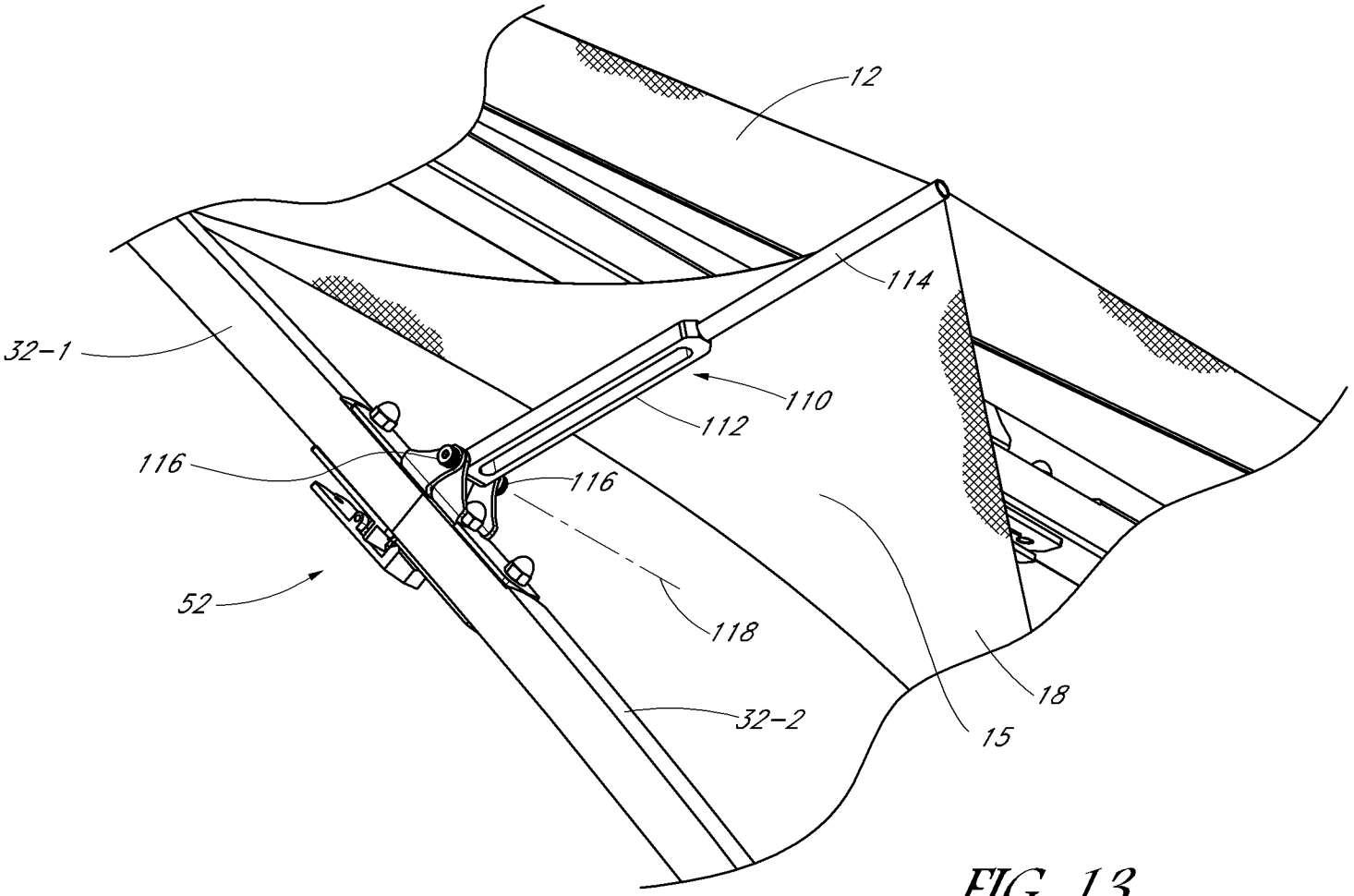
FIG. 13 is a perspective view illustration of an example sail riser assembly supporting sail elements.

In some embodiments, a sail riser 110 may be pivotally attached to a leg hinge mechanism 52, such as by one or more pins 116 through a sail riser pivot axis 118, as shown in FIG. 13. The lower sail riser section 112 may be configured to sit between hinge pin flanges 76*a*, 76*b*, 78*a*, 78*b*. Alternatively, the lower section 112 of the sail riser 110 may be configured to straddle hinge-pin flanges 76*a*, 76*b*, 78*a*, 78*b*. The lower sail riser section 112 may include a hole for receiving an attachment mechanism such as a screw, pin, bolt or other suitable attachment mechanism. In some embodiments, the pin may be coaxial with, collinear with, or integral with one or more hinge pins defining the pivot axis of the leg hinge 52. The sail riser 110 may be configured to support a portion of upper and/or lower sails by extending approximately perpendicular to a leg member (or perpendicular to a line tangential to a curved leg). Alternatively, a sail riser 110 may extend at any other angle relative to a corresponding leg member.

A sail riser 110 attached to a pivot pin 116 (or otherwise pivotally attached to a leg member) may be free to pivot through an entire angle between a lower leg segment 36-1 and an upper leg segment 36-2 (e.g., about 180°). Alternatively, the range of rotation of the sail riser 110 relative to the leg may be constrained to inhibit or prevent rotation of the sail riser 110 beyond a desired point. For example, the sail riser may be restricted to rotate of up to 10°, 20°, 30° or 45° in one or both directions from a position perpendicular to the leg. In some embodiments, one or more tension cords attached to the sail riser 110 and to a point on a leg member 36-1 or 36-2 may be used to limit rotation of a sail riser 110. In some embodiments rotation of a sail riser 110 may be limited by mechanical stops such as pins, flanges or shoulders. In alternate embodiments, a sail riser 110 may be substantially rigidly attached to a leg 32, 34, 36, 38 in a desired orientation. In still further embodiments, a sail riser 110 may be removable from a holder, clamp, or other structure configured to hold a removable sail riser in a desired orientation.

In some embodiments, a sail riser 110 pivotally mounted to a leg member 32, 34, 36, 38 may be retained in a desired orientation by tension in the sails 12, 14, 16, 18 themselves. As will be described in further detail below, the sails 12, 14, 16, 18 may be attached to the frame 20 such that they are stretched between attachment points. In some embodiments, the tensile forces of stretched sail segments may be balanced to retain a sail riser 110 in a desired position so as to retain the portion of the sails attached to the riser in a desired position.

With reference to FIG. 2, in some embodiments, the ridge spine 40 may be made of a plurality of segments, such as two approximately equal-length segments. The segments can be joined with a lockable ridge hinge 120 mechanism. In some embodiments, the ridge spine locking hinge (which may also be referred to herein as a "spine hinge," a "ridge hinge," or a "locking ridge hinge") 120 may be substantially the same as the leg hinge locking mechanism 52 while omitting the sail riser 110. In some embodiments, the ridge spine locking hinge 120 may be of a different design or construction than the leg hinge mechanisms 52.

The leg members 32, 34, 36, 38 and ridge spine 40 may be any dimension deemed suitable for a desired use. For example, some embodiments having leg members and ridge spine members with a length of between about seven feet and ten feet in length may be well-suited to shelters for use by about two to about six adult occupants. Certain embodiments with slightly smaller leg members and ridge spine member, such as about six feet to about seven feet, may be well-suited for a smaller number of occupants. Structures may be made smaller still, e.g., with a ridge spine and leg members of about three feet to about five feet, such as to provide a structure that may be well suited for children.

The ridge spine 40 may have a full length substantially equal to the full length of the leg members 32, 34, 36, 38. Alternatively, the ridge spine 40 may be longer or shorter than the leg members 32, 34, 36, 38 as desired. The ridge spine 40 may be substantially straight, or may be curved with a convex surface facing either up or down as desired.

In some embodiments, the intersection of two legs 32, 34 or 36, 38 and one end of the ridge spine 40 may comprise a hinge mechanism (e.g., a multi-axis hinge 130, which may also be referred to herein as a "leg-ridge hinge"). As is described in more detail below, the multi-axis hinge 130 can be configured to allow all three elements (e.g., too legs 32, 34 or 36, 38 and one end of the ridge spine 40) to pivot to allow folding of the shelter without detaching elements from one another. In some embodiments, each end of the ridge spine 40 may include a multi-axis hinge 130. In various embodiments, the multi-axis hinge 130 may comprise two pivot axes, three pivot axes or more than three pivot axes.

Figure 11:
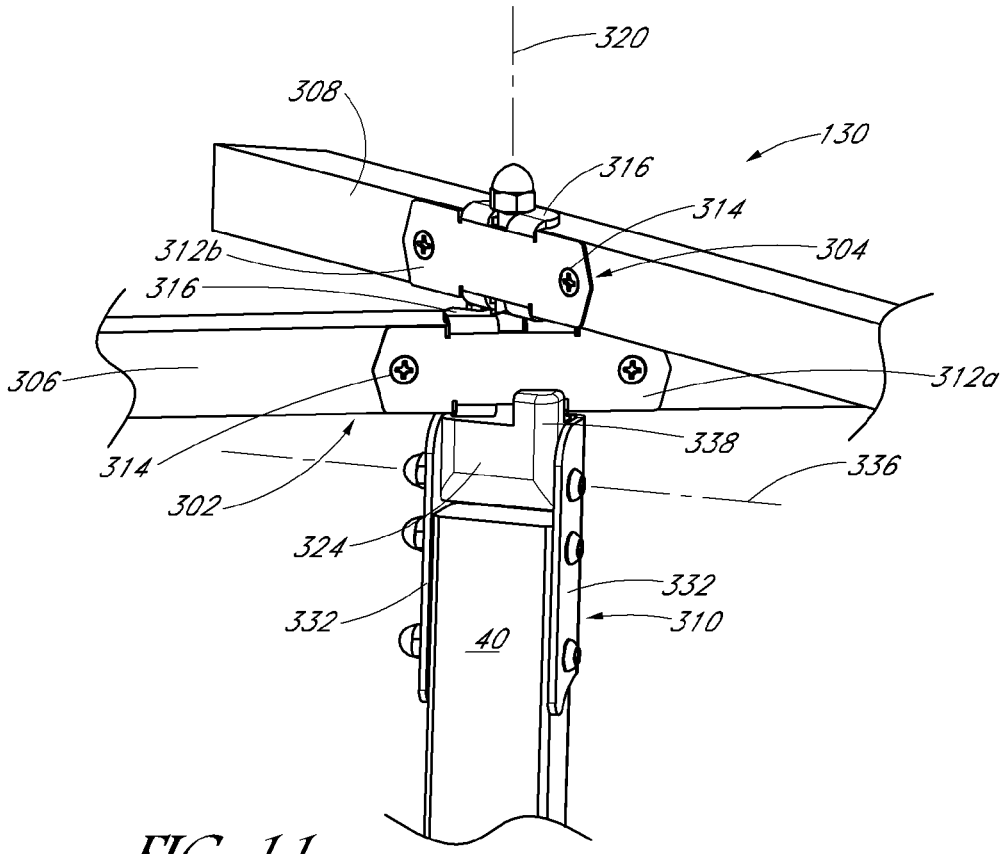
FIG. 11 is a bottom perspective view illustration of an example multi-axis hinge assembly.
Figure 12:
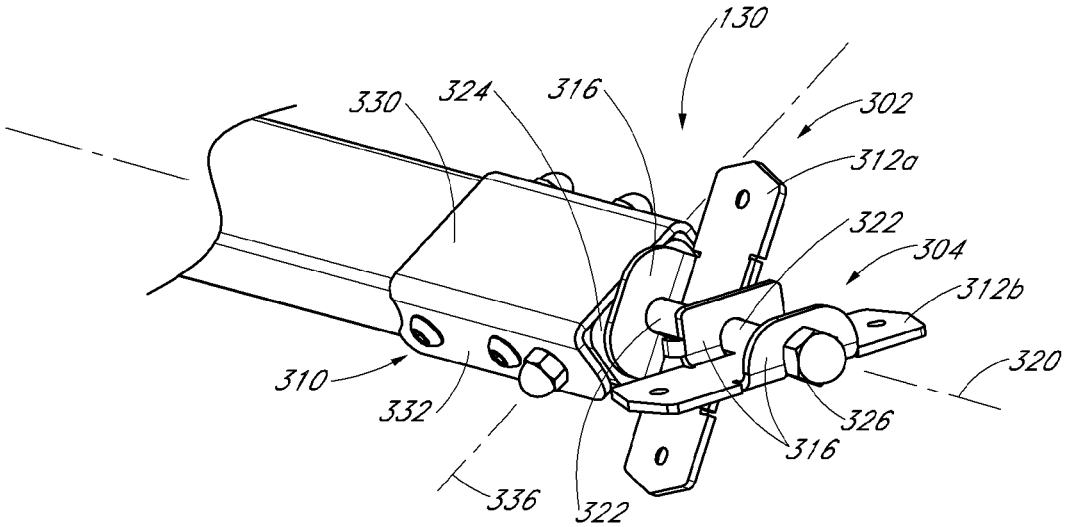
FIG. 12 is a top perspective view illustration of an example multi-axis hinge assembly.

FIG. 11 and FIG. 12 illustrate an example embodiment of a multi-axis hinge mechanism 130. The multi-axis hinge mechanism 130 may include an inner leg-attachment section 302 for receiving an inner leg member 306, an outer leg-attachment section 304 for receiving an outer leg member 308, and a ridge spine attachment section 310 for receiving a portion of the ridge spine 40. The inner 302 and outer 304 leg attachment sections may each include a lower plate 312*a*, 312*b* that may be secured to the respective leg member 306, 308 by fasteners 314 such as screws, nut/bolt pairs, rivets, or other mechanical fasteners, or by adhesives, welds, or other fastening methods. In some embodiments, the inner 302 and outer 304 leg attachment sections may include a top plate (not shown) positioned on an opposite surface of a leg member from a lower plate 312. The lower plate 312*a*, 312*b* of each leg attachment section 302, 304 may include one or more flanges 316 extending upwards towards the upper plate. The flanges 316 may extend into, through, and/or around the leg member 306 or 308 to which the lower plate 312*a*, 312*b* is attached.

The multi-axis hinge mechanism 130 may include a leg swing axis 320 about which the inner and outer leg attachment sections 302, 304 may pivot relative to one another and relative to the ridge spine attachment section 310. In some embodiments, the leg swing axis 320 may be defined by a pin, screw, bolt, rod or other structure extending through apertures 322 in each of the flanges 316 and attached to a base block 324. In various embodiments, the bolt 326 (or other structure) may be either fixedly or pivotally secured to the base block 324. Alternatively, any other retaining structure may be used to retain the leg attachment sections on a structure (e.g., screw, bolt, pin, rod, etc.) defining the leg swing axis, such as a cotter pin, a retaining clip, a split ring, or others. In various embodiments, one or more washers or spacers may be provided in a space between the inner and outer leg attachment sections 302, 304. Similarly, a washer or spacer may be provided in a space between the base block 324 and the inner leg attachment section 302, and/or in a space between a bolt head 326 and the outer leg attachment section 304. In some embodiments, the flanges 316 may be omitted from the leg attachment sections 302, 304, and the leg swing axis may be defined by through holes, blind holes, threaded inserts, un-threaded inserts or other structures in the leg members 306, 308.

The ridge spine attachment section 310 may include a channel engaged with the ridge spine 40. In some embodiments, the channel may include a generally U-shaped channel comprising a back section 330 and a pair of flange sections 332 extending from the back section 330. In some embodiments, as shown for example in FIG. 11 and FIG. 12, the ridge spine 40 may be secured to the ridge spine attachment section 310 by screws, nut/bolt pairs, rivets, other mechanical fasteners, or by adhesives, welds, or other fastening methods. In some embodiments, the channel may comprise an enclosed tube with a rectangular or other cross-sectional shape.

The multi-axis hinge mechanism 130 may also include a ridge pivot axis 336 about which the ridge spine attachment section 310 may pivot relative to the inner and outer leg attachment sections 302, 304. In some embodiments, the ridge pivot axis 336 may be defined by one or more pins, bolts, screws or other structures extending through the flange sections 332 and into the base block 324, thereby allowing the base block to pivot about the ridge pivot axis relative to the ridge spine attachment section 310. The ridge pivot axis 336 may be defined by a single bolt extending through holes in the flange sections 332 and through the base block 324. Alternatively, the pivot axis may be defined by a pair of screws extending through holes in the flanges 332, and into one or more threaded holes (or threaded inserts) in the base block 324.

In some embodiments, the multi-axis hinge mechanism 130 may include one or more stops configured to limit rotation of one or more components relative to others. For example, the base block 324 may include a stop 338, such as a protrusion extending parallel to the leg swing axis 320. The stop 338 can be arranged to engage (e.g., by providing a physical interference with) the inner leg attachment section 302 to limit rotation of the inner leg 306 relative to the base block 324. Similarly, one or both leg attachment sections may include stops to limit rotation of the legs relative to one another.

A base block 324 may be configured to engage a portion of a back section 330 of the ridge spine attachment section 310 so as to limit rotation of the base block 324 relative to the ridge spine 40. In some embodiments, the ridge spine attachment section 310 and base block 324 may be configured to support the leg swing axis 320 in an orientation substantially parallel to a longitudinal axis of the ridge spine 40.

In various embodiments, the sails may be attached to the frame at various points by any of a wide range of suitable attachment mechanisms. For example, the frame may include screws, pins, nails, bolts, hooks, snaps, toggles, buttons, clips, clamps, knobs or other structures configured to provide a plurality of individual points of attachment for fabric sails. Some example locations for sail attachment points are further described above.

As shown in FIG. 2, FIG. 7, FIG. 14, and FIG. 15, a shelter frame 20 may include diagonal cross-support members 160 extending from an attachment point 166 on the ridge spine member 40 to an attachment point 170 on a leg member 32. In various embodiments, the diagonal cross support members 160 may removably attached to either or both of the ridge spine 40 and a leg member 32. In some embodiments, the diagonal cross support members 160 may include one or more lockable hinge mechanisms that may be released to allow the shelter structure to be folded and collapsed.

Figure 14:
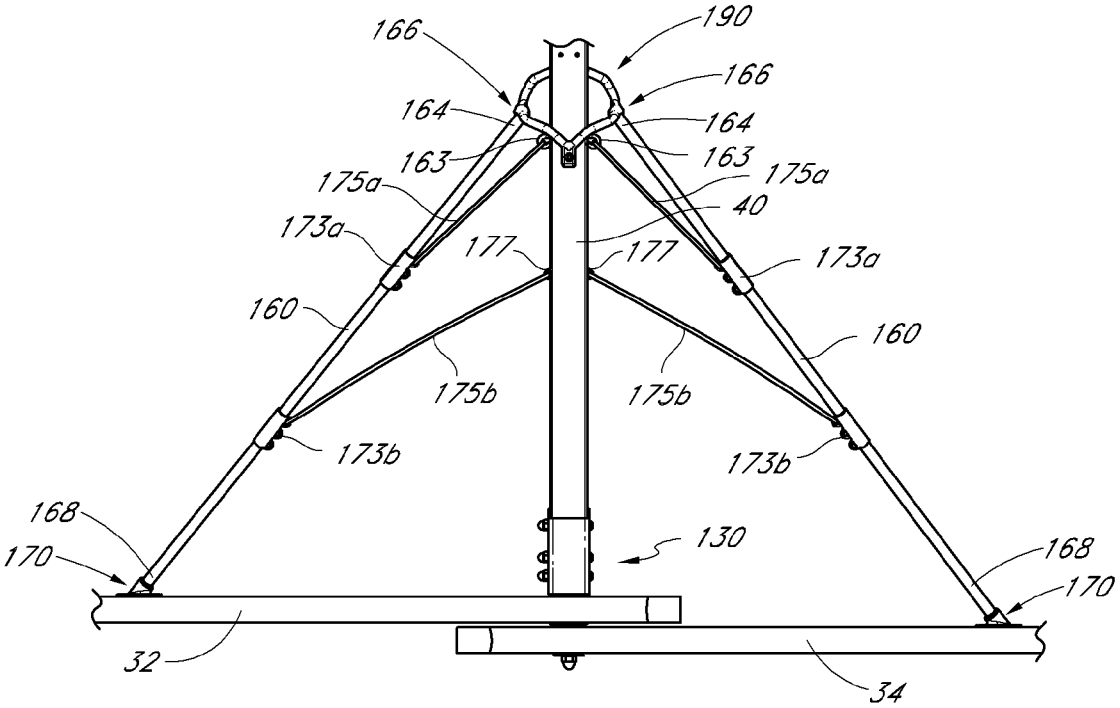
FIG. 14 is a top plan view illustration of an example diagonal support member assembly.
Figure 15:
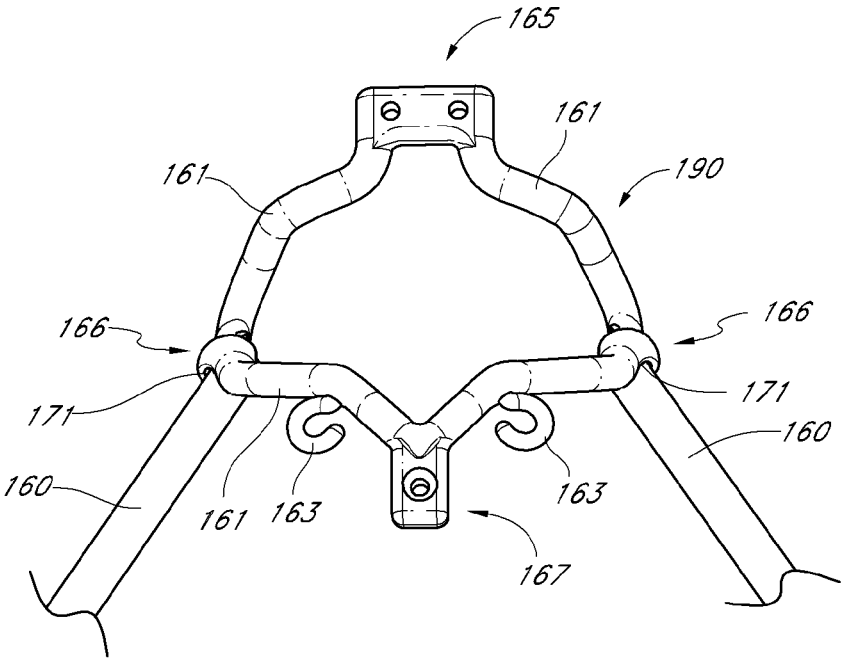
FIG. 15 is a top plan view illustration of an example catch device.
Figure 16A:
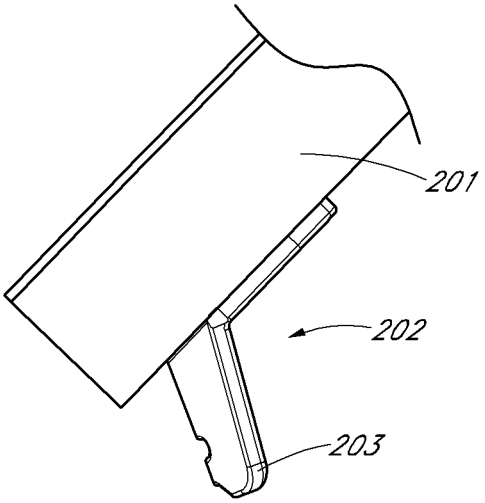
FIG. 16A-FIG. 16D are perspective illustrations of an example foot cleat.
Figure 16B:
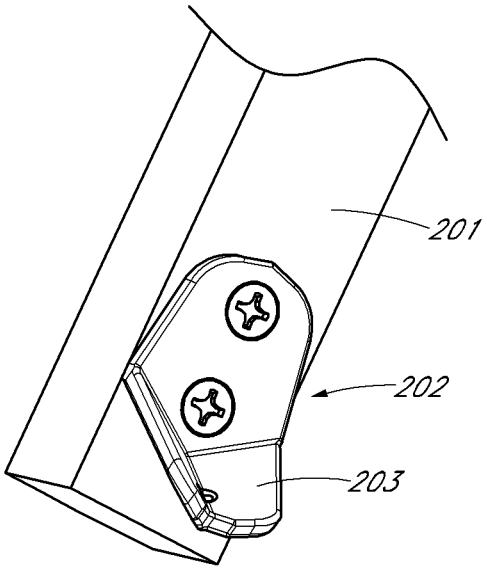
Figure 16C:
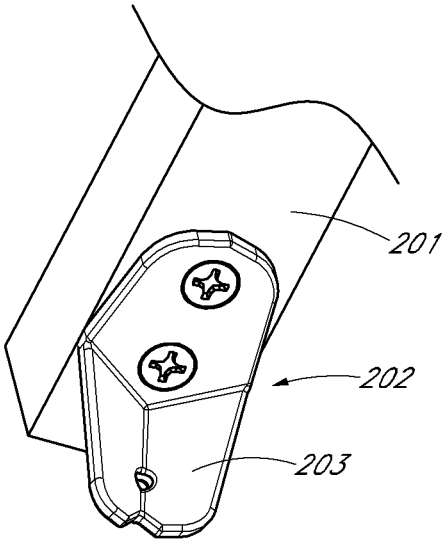
Figure 16D:
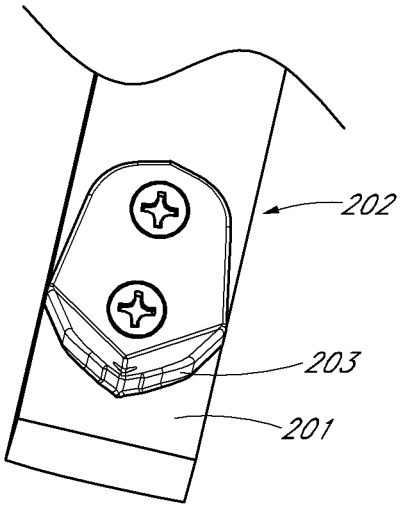

FIG. 14 and FIG. 15 illustrate an example embodiment of a diagonal cross support member 160 configured to be removably attached to both the ridge spine 40 and to a leg member 32. In some cases, the diagonal cross support members 160 may generally be configured to primarily support a compressive load between its ends.

In some embodiments, the diagonal cross support member 160 may be configured to be removable from a supporting position, such as from the supporting position shown in FIG. 14. In some embodiments, the diagonal cross support member 160 may be configured to be movable to a storage position, such as a position in which the diagonal cross support member 160 is retained against and parallel to the ridge spine 40. In some embodiments, the shelter frame and/or the diagonal cross support member 160 may be configured to store the diagonal cross support member 160 in a storage position parallel to and in contact with an upper leg member section 32-1 or a lower leg member section 32-2.

In the example illustrated in FIG. 14, the diagonal cross support member 160 may be attached to the ridge spine 40 by positioning an upper end 164 of the diagonal cross support member 160 on an attachment point 166 mounted to the ridge spine 40, and positioning the lower end 168 of the diagonal cross support member 160 on an attachment point 170 mounted to the leg member 32. In some embodiments, attachment posts 166, 170 may comprise concave attachment cups configured to receive an end 164, 168 of the diagonal cross support member 160. In some embodiments, the attachment points 166, 170 may include one or more posts configured to extend into a recess within each end 164, 168 of the diagonal cross support member 160. In some embodiments, the diagonal cross support member 160 may attach to the ridge spine 40 and the leg member 32 by other mechanisms.

In some embodiments, the diagonal cross support member 160 may have a length configured for substantially supporting the ridge spine 40 and a leg member 32, 34, 36, 38 in a desired orientation relative to one another. For example, in some embodiments, an upper end 164 of a diagonal cross support member 160 may attach to the ridge spine 40 at a point approximately ¼ of the distance from the nearest end of the ridge spine 40 and to a leg member 32 at a point approximately ⅔ of the distance along the leg member from the multi-axis hinge to the leg hinge 52.

In some embodiments the attachment points 166 for the diagonal cross support member 160 on the ridge spine 40 may be provided by a catch device 190, such as is shown in FIG. 14 and FIG. 15. The catch device 190 may include a lower attachment section 165 an upper attachment section 167, attachment points 166, and cord-loops 163. The lower attachment section 165 may be joined to the attachment points 166 and to the upper attachment section 167 by strut members 161 extending between the various structures. The lower attachment section 165 may be configured to be secured to the lower surface of the ridge spine member 40. The upper attachment section 167 may be configured to be secured to the upper surface of the ridge spine member 40. The attachment sections 165, 167 may be secured to the ridge spine 40 by mechanical fasteners such as screws, bolts, pins, rivets, nails or others, or by adhesives, welds, or other fastening methods.

In some embodiments, each attachment point 166 may comprise a body member which may have a generally spherical, cylindrical, rectangular prismatic, or other shape, and which may include a concave recess 171 configured to receive an end 164 of a diagonal support member 160. Other receiving structures are also possible.

The catch device 190 may include cord loops 163 configured to receive one or more retaining cords configured to retain one or more structures in a desired configuration. For example, in some embodiments a bungee cord 175*a* (or other flexible biasing member) may be attached to one of the cord loops 163 on the catch device 190 and to an attachment point 173*a* on a diagonal support member 160. A second bungee cord 175*b* may be joined to a second attachment point 173*b* on the diagonal support member 160 and a point 177 on the ridge spine 40 so as to bias the diagonal support member 160 towards the ridge spine 40 when the diagonal support member is released from the attachment points 166, 170. When the diagonal support member 160 is detached from the upper 166 and lower 170 attachment points, the cords 175*a*, 175*b* may bias the diagonal support member towards a storage position as described in further detail above.

In some embodiments, the diagonal cross support member 160 may also be attached to the frame 20 by one or more of the flexible biasing members 175*a*, 175*b*. For example, one or more of the flexible biasing members 175*a*, 175*b* may be attached to the diagonal cross support member 160 and the frame 20 in such a way as to bias the diagonal cross support member 160 towards the storage position. In some embodiments, in the storage position, the diagonal cross support member 160 is generally parallel with the ridge spine 40. In certain implementations, when the diagonal cross support member 160 is not in a supporting position (such as that shown in FIG. 14) the bias of one or more of the flexible biasing members 175*a*, 175*b* applies a force that encourages the diagonal cross support member 160 toward the storage position (e.g, by encouraging the diagonal cross support member 160 to rotating into generally parallel alignment with the ridge spine 40). Some suitable biasing devices may include bungee cords, springs, cables, pulleys, counterweights, etc.

As shown in FIG. 1 and FIG. 2, each leg member 32, 34, 36, 38 may include a foot 200 at a lower end thereof. The shape and configuration of a foot may vary depending on the terrain on which the structure is to be used. For example, in some embodiments, the foot end of each leg member 32, 34, 36, 38 may include an enlarged foot configured to inhibit or prevent the foot from digging into grass or soil.

Alternatively, a foot cleat 202, such as the foot cleat illustrated in FIG. 16A-FIG. 16D, may be attached to or integrally formed with the bottom of the leg member 201. The foot cleat 202 of FIG. 16A-FIG. 16D may include one or more dulled-claw shaped tab 203 extending at an angle (e.g., of at least approximately 45°) to the axis of the leg member 201. In some embodiments, the foot cleat 202 extends approximately vertically downward from a leg member 201. In certain variants, the foot cleat 202 may be configured to dig into a soft surface such as soil, grass or sand. The foot cleat 202 of FIG. 16A-FIG. 16D may benefit by inhibiting or preventing the leg members 201 from sliding outwards. In some embodiments, a tab 203 may extend about 1", 2", 3" or more from the leg member 201, e.g., as measured along a line extending at 45 degrees from the lower surface of the leg member 201. A tab-shaped foot cleat 202 may be made of metal, plastic, or other suitable material. In some embodiments, a foot cleat 202 may be removable from the leg member 201. In some embodiments, the foot cleat 202 may comprise, or be covered with, a rubber "sock" to inhibit or prevent slipping or marring when the shelter is placed on a hard surface such as concrete or tile.

Certain Examples of Use and Operation

Figure 19:
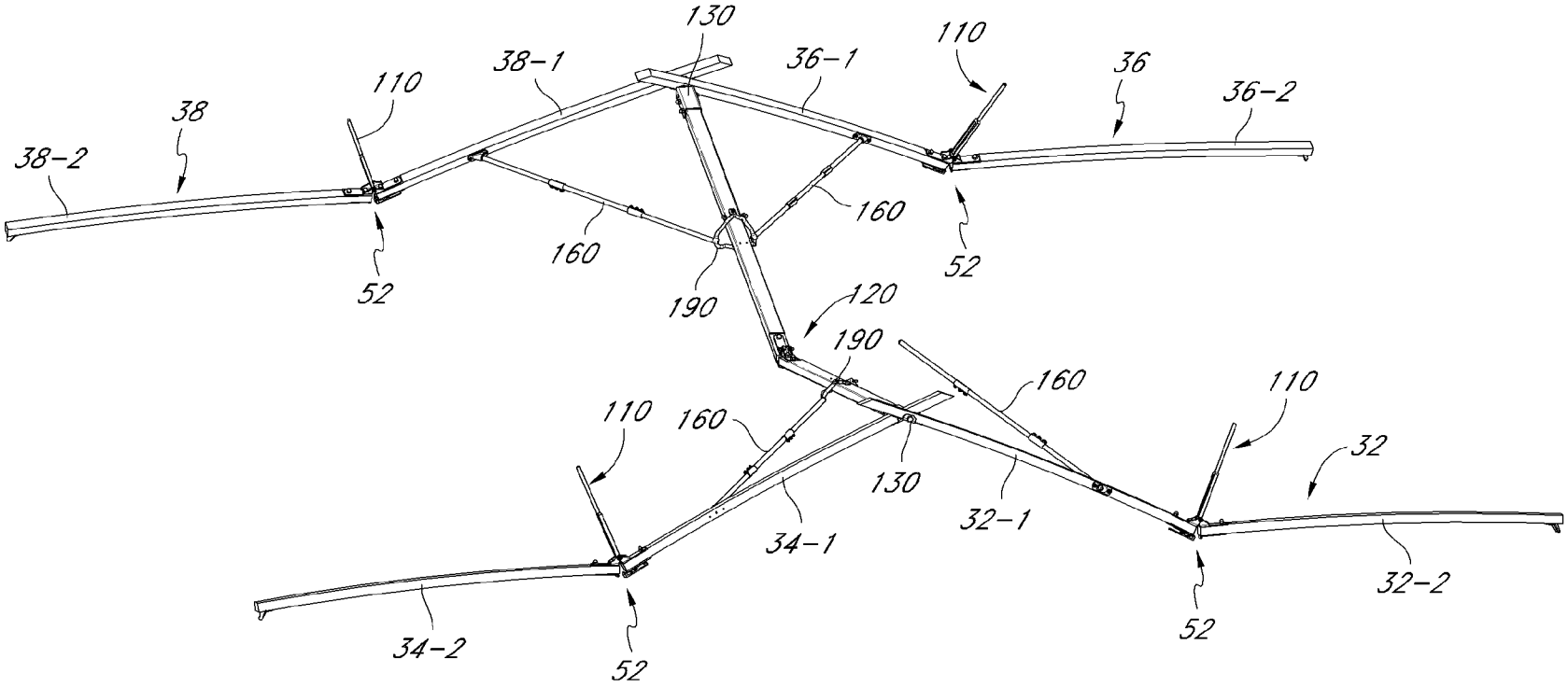
FIG. 19 is a perspective illustration of an example sun shelter frame in a partially-folded configuration.

FIG. 19 illustrates the frame 20 with various parts in a partially folded orientation. With reference to FIG. 1 and FIG. 19, in some embodiments, a shelter 10 with sails 12, 14, 16, 18 attached to a frame 20 may be configured to fold into a compact shape. Some embodiments are configured to fold without removing parts. The folded shape may be configured such that the folded shelter may be strapped behind a person's back, carried under a person's arm or over a person's shoulder, and may be sized to fit horizontally into the trunk of a car.

The shelter 10 may be taken down and collapsed by one person, two people, or more. A two person take down will be described for simple illustration. It should be noted that the take-down steps may be performed in any sequence as desired.

The shelter 10 may be configured to collapse, such as by being folded. In some embodiments, such folding may include unlocking the ridge spine hinge, thereby allowing the spine hinge 120 to move downwards. In some embodiments, the multi-axis hinges 130 and attached portions of the ridge spine 40 may be moved (e.g., folded) towards one another. In some embodiments, the two front leg members 32, 34 may be moved (e.g., walked) towards the two back legs 36, 38, such as until the spine sections 40 contact one another. The leg members 32, 34 may be moved (e.g., folded together), such as by pivoting them towards one another about the leg swing axis. In some variants, the leg members 36, 38 may be moved (e.g., folded together), such as by pivoting them towards one another about the leg swing axis. In some embodiments, some or each of the leg hinges 52 may be un-locked and/or disengaged. This can allow the bottom leg sections 32-2, 34-2, 36-2, 38-2 to move (e.g., fold upwards) towards the corresponding top leg sections 32-1, 34-1, 36-1, 38-1. With the leg hinges unlocked, the legs 32, 34, 36, 38 may be collapsed (e.g., folded) completely (e.g., to an abutting and/or a rest position). In some embodiments, the shelter 10 may be placed in a container (e.g., a bag) or otherwise secured in a folded configuration (e.g., with straps).

The shelter 10 may be set up by reversing the above steps. In some embodiments, a method of setting-up of the shelter 10 may include extending (e.g., unfolding) the legs 32, 34, 36, 38. In some embodiments, the method includes securing (e.g., locking) the leg hinges 52. The method can include separating the legs 32, 34 from the legs 36, 38. Some implementations may include extending (e.g., unfolding) the spine ridge 40, such as by moving the spine hinge 120 generally upwardly. Certain variants include securing the spine ridge 40, such as by locking the spine hinge 120. In some embodiments, the method includes rotating the legs 32, 34 and/or 36, 38 relative to each other and/or relative to the spine ridge 40. For example, the method can include rotating the legs 32, 34 and/or 36, 38 about the leg swing axis of the multi-axis hinge. In certain implementations, the leg 32 can be pivoted in one direction (e.g., clockwise) and the leg 34 can be pivoted in another direction (e.g., counter-clockwise).

In some embodiments, the method includes spacing distal ends of the legs 32, 34 apart, and spacing distal ends of the legs 36, 38 apart. In some embodiments, the distance between the distal ends of the legs 32, 34 and the distance between the distal ends of the legs 36, 38 is about equal (e.g., less than 10% different). In some embodiments, the distance between the distal ends of the legs 32, 34 and the distance between the distal ends of the legs 36, 38 is unequal. This can facilitate positioning the shelter 10 on a surface that is not horizontal, such as a grade or dune on a beach. In some embodiments, the distance between the distal ends of the legs 32, 34 is less than (e.g., at least 20% less than) the distance between the distal ends of the legs 36, 38. This can result in the vertical height of the shelter 10 at the intersection of the legs 32, 34 being higher than the vertical height of the shelter 10 at the intersection of the legs 36, 38, which can aid in compensating for a change in topography. In some implementations, the shelter 10 is configured to enable the ridge spine 40 to be positioned generally parallel with horizontal even when then surface on which the shelter 10 rests is not horizontal. For example, some embodiments are configured such that the ridge spine 40 can be positioned generally parallel with horizontal by moving the legs 32, 34 and/or the legs 36, 38 closer or farther from each other.

Certain Accessories

Figure 17:
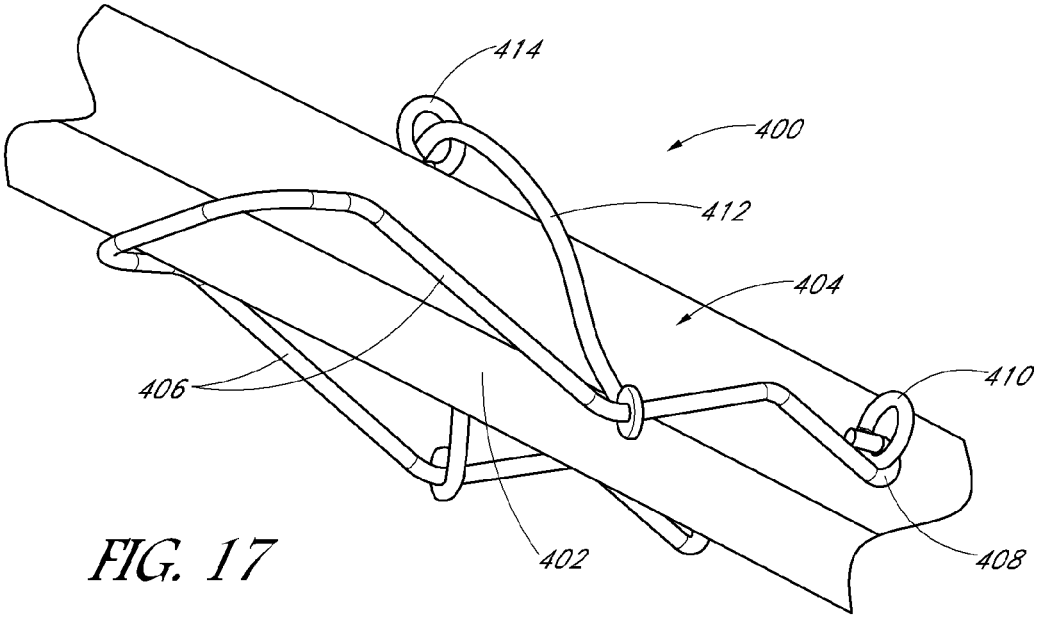
FIG. 17 is a perspective illustration of an example holder attached to a leg member of a sun shelter.
Figure 18:
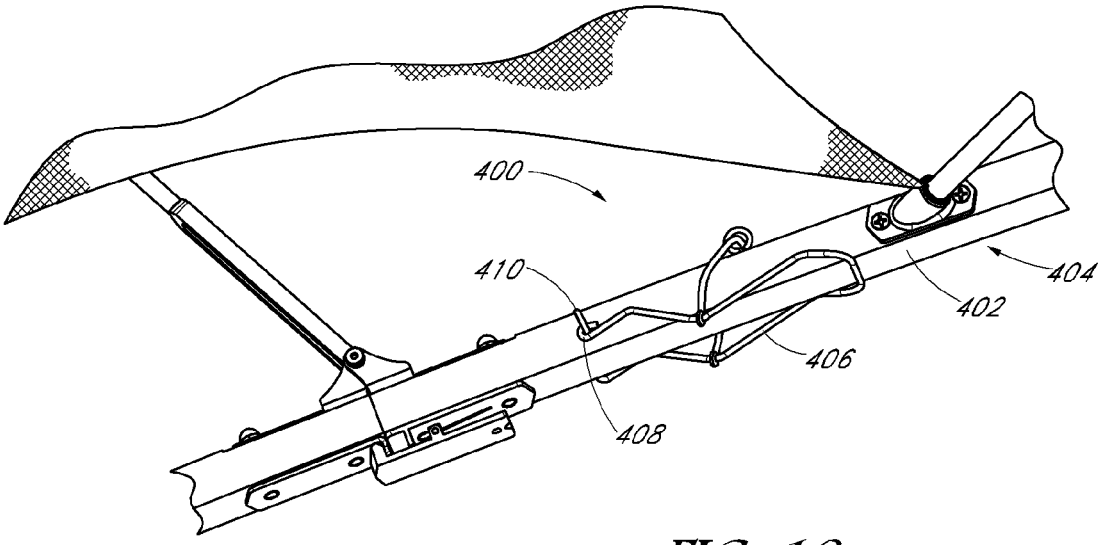
FIG. 18 is a perspective illustration of an example holder attached to a leg member of a sun shelter.

The shelter 10 may also include one or more accessories configured to attach to the frame 20 and/or the sails 12, 14, 16, 18. Examples of accessories may include a surfboard holding device, a holder (e.g., for holding a bottle of sunscreen), netting, lockable storage pouches, and others. In some embodiments, the accessories may be attached to one or more of the legs 32, 34, 36, 38, such as with a fastener (e.g., a screw or bolt) or a flexible member (e.g., a rope or bungee cord). In some embodiments, certain accessories extend across an interior portion of the shelter 10. For example, in the configuration shown in FIG. 1, the netting can extend between the upper sails 12, 14 to provide a location to store articles, FIG. 17 and FIG. 18 illustrate a collapsible holder 400, such as a holder for holding a bottle of sunscreen. In some embodiments, the holder 400 may be attached to the bottom side 402 of a top leg segment 404. The holder 400 may be configured to secure the body of a bottle of sunscreen, angled downward, so that users can open the cap and squeeze the bottle in place to distribute sunscreen on their hand without removing the bottle from its secured position.

The holder 400 may comprise a frame 406 made of metal wire, plastic, or other material formed into a cage shape. The frame 406 may be pivotally attached to the leg member 404 by loops 408 formed in the frame 406 passing through eyes 410 secured to the leg member 404. The frame 406 may be biased towards the leg member 404 by a biasing member 412 such as a bungee cord, rubber band, spring, etc. The biasing member 412 may be retained in a desired position along the leg 404 by an eye 414 or other retaining structure.

CERTAIN TERMINOLOGY

Terms of orientation used herein, such as "top," "bottom," "horizontal," "vertical," "longitudinal," "lateral," and "end" are used in the context of the illustrated embodiments. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semicylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may indicate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may indicate, the term "generally parallel" can refer to something that departs from exactly parallel by less than or equal to 20 degrees and the term "generally perpendicular" can refer to something that departs from exactly perpendicular by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

SUMMARY

Although the shelter has been disclosed in the context of certain preferred embodiments and examples, it will be understood by those skilled in the art that this disclosure extends beyond the specifically disclosed embodiments to other alternative embodiments and/or uses of the shelter and obvious modifications and equivalents thereof. Various modifications to the above embodiments will be readily apparent to those skilled in the art, and the principles described herein may be applied to other embodiments without departing from the spirit or scope of this disclosure. Thus, it is intended that the scope of this disclosure should not be limited by the particular disclosed embodiments described. Various features and aspects of the disclosed embodiments can be combined with or substituted for one another in order to form varying modes of the shelter. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination. Further, the claims may be drafted to exclude any disclosed element. The preceding sentence is intended to serve as antecedent basis for use of exclusive terminology (e.g., "solely," "only," and the like) in connection with the recitation of claim elements, or use of a "negative" limitation.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of shelters have been disclosed. Although the shelters have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular disclosed embodiments described above, but should be determined only by a fair reading of the claims that follow.

What is claimed is:

1. A shelter device comprising:

a frame structure comprising:

a substantially longitudinal ridge beam having:

a first multi-axis hinge device adjacent to a first end;

a second multi-axis hinge device adjacent to a second end; and a locking ridge hinge device adjacent to a midpoint between the first and second multi-axis hinge devices;

a first leg member;

a second leg member;

the first and second leg members being joined to one another and to the first end of the ridge beam by the first multi-axis hinge device;

the first multi-axis hinge device having a first pivot axis that is generally parallel to the ridge beam, the first and second leg members being configured to pivot about the first pivot axis relative to one another and relative to the ridge beam;

the first multi-axis hinge device having a second pivot axis that is generally perpendicular to the ridge beam, the ridge beam being configured to pivot relative to the first and second leg members about the second pivot axis;

wherein each of the first and second leg members has a foot portion at an end distal from the first multi-axis hinge device and a locking leg hinge mechanism, the locking leg hinge mechanism positioned in a middle region of the length between the first multi-axis hinge device and the foot portion;

a third leg member;

a fourth leg member;

the third and fourth leg members being attached to the second multi-axis hinge device;

a first upper sail extending between and attached to the first leg member and the third leg member;

a first lower sail extending between and attached to the first leg member and the third leg member;

a second upper sail extending between and attached to the second leg member and the fourth leg member;

a second lower sail extending between and attached to the second leg member and the fourth leg member; and a first sail riser attached to the locking leg hinge mechanism of the first leg member and extending generally upwards from the first leg member, wherein a portion of the first upper sail and a portion of the first lower sail are attached to an upper portion of the first sail riser.

2. The shelter device of claim 1, wherein the first sail riser is pivotable relative to the first leg member.

3. The shelter device of claim 2, wherein the first sail riser is pivotable about an axis that is collinear with a pivot axis of the locking leg hinge mechanism of the first leg member.

4. The shelter device of claim 1, wherein the locking ridge hinge device is structurally identical to the locking leg hinge mechanisms of the first and second leg members.

5. The shelter device of claim 1, wherein each of the first upper sail, the first lower sail, the second upper sail, and the second lower sail is made of a stretchable material and is attached to the frame in a stretched configuration with a greater surface area than a relaxed configuration.

6. The shelter device of claim 5, wherein each of the first upper sail, the first lower sail, the second upper sail, and the second lower sail is made of a fabric with a maximum elongation percent that is at least 10% greater than a percent difference between the relaxed configuration and the stretched configuration of each sail.

7. The shelter device of claim 1, wherein the foot portion of each of the first and second leg members comprises a cleat structure extending at an angle of approximately 45 degrees from the leg member.

8. The shelter device of claim 1, wherein each of the first leg member and the second leg member is curved with a concave surface facing downwards in an un-folded configuration.

9. The shelter device of claim 1, further comprising a first diagonal support member extending between the ridge beam and the first leg.

10. The shelter device of claim 9, wherein the diagonal support member is removably attached to attachment points on both the ridge beam and the first leg member.

11. The shelter device of claim 9, wherein the diagonal support member comprises a locking hinge.

12. The shelter device of claim 9, wherein the diagonal support member is movable between a supporting position in which the diagonal support member is removably attached to attachment points on both the ridge beam and the first leg member and a storage position in which the diagonal support member is supported parallel to the ridge beam or the first leg member.

13. The shelter device of claim 1, further comprising a sunscreen holder comprising a cage pivotally attached to the first leg member and biased upwards by a biasing device, the sunscreen holder being sized and configured to support a sunscreen bottle against a lower surface of the first leg member.

14. The shelter device of claim 1, wherein the first upper sail is independent of the first lower sail.

15. The shelter device of claim 1, wherein the upper sail further comprises a bottom edge about midway between the ridge beam and the foot portions of the first and third leg members.

16. The shelter device of claim 1, wherein the lower sail further comprises a top edge that is closer to the ridge beam than the lower edge of the first upper sail.

17. A shelter device comprising:

a frame structure comprising:

a substantially longitudinal ridge beam having:

a first multi-axis hinge device adjacent to a first end;

a second multi-axis hinge device adjacent to a second end;

a locking ridge hinge device adjacent to a midpoint between the first and second multi-axis hinge devices; and a catch device comprising a first portion attached to a lower surface of the ridge beam and a second portion attached to an upper surface of the ridge beam, the catch device comprising an attachment feature of the ridge beam;

a first leg member;

a second leg member;

the first and second leg members being joined to one another and to the first end of the ridge beam by the first multi-axis hinge device;

the first multi-axis hinge device having a first pivot axis that is generally parallel to the ridge beam, the first and second leg members being configured to pivot about the first pivot axis relative to one another and relative to the ridge beam;

the first multi-axis hinge device having a second pivot axis that is generally perpendicular to the ridge beam, the ridge beam being configured to pivot relative to the first and second leg members about the second pivot axis;

wherein each of the first and second leg members has a foot portion at an end distal from the first multi-axis hinge device and a locking leg hinge mechanism, the locking leg hinge mechanism positioned in a middle region of the length between the first multi-axis hinge device and the foot portion;

a third leg member;

a fourth leg member;

the third and fourth leg members being attached to the second multi-axis hinge device;

a first upper sail extending between and attached to the first leg member and the third leg member;

a first lower sail extending between and attached to the first leg member and the third leg member;

a second upper sail extending between and attached to the second leg member and the fourth leg member;

a second lower sail extending between and attached to the second leg member and the fourth leg member; and a first diagonal support member extending between the ridge beam and the first leg member, wherein the shelter device is configured such that:

in a first state, a first end of the diagonal support member is engaged with the attachment feature of the ridge beam and a second end of the diagonal support member is engaged with an attachment feature of the first leg member; and in a second state, at least the first end of the diagonal support member is disengaged with the attachment feature of the ridge beam.

18. The shelter device of claim 17, wherein, in the second state, the first end of the diagonal support member is a free end that is spaced apart from, and not connected to, the ridge beam.

19. The shelter device of claim 17, wherein the attachment features of the ridge beam and the first leg member each comprise concave cups configured to receive respective first and second ends of the diagonal support member.

20. The shelter device of claim 17, further comprising a second diagonal support member extending between the ridge beam and the second leg member.

21. The shelter device of claim 20, further comprising a third diagonal support member extending between the ridge beam and the third leg member, and a fourth diagonal support member extending between the ridge beam and the fourth leg member.

22. The shelter device of claim 17, wherein the first diagonal support member is configured to be retained generally parallel to the ridge beam.

23. The shelter device of claim 17, further comprising a first sail riser, wherein the first sail riser is pivotable relative to the first leg member.

24. The shelter device of claim 17, further comprising a first sail riser, wherein the first sail riser is pivotable about an axis that is collinear with a pivot axis of the locking leg hinge mechanism of the first leg member.

25. A shelter device comprising:

a frame structure comprising:

a substantially longitudinal ridge beam having:

a first multi-axis hinge device adjacent to a first end;

a second multi-axis hinge device adjacent to a second end; and a locking ridge hinge device adjacent to a midpoint between the first and second multi-axis hinge devices;

a first leg member;

a second leg member;

the first and second leg members being joined to one another and to the first end of the ridge beam by the first multi-axis hinge device;

the first multi-axis hinge device having a first pivot axis that is generally parallel to the ridge beam, the first and second leg members being configured to pivot about the first pivot axis relative to one another and relative to the ridge beam;

the first multi-axis hinge device having a second pivot axis that is generally perpendicular to the ridge beam, the ridge beam being configured to pivot relative to the first and second leg members about the second pivot axis;

wherein each of the first and second leg members has a foot portion at an end distal from the first multi-axis hinge device and a locking leg hinge mechanism, the locking leg hinge mechanism positioned in a middle region of the length between the first multi-axis hinge device and the foot portion;

a third leg member;

a fourth leg member;

the third and fourth leg members being attached to the second multi-axis hinge device;

a first upper sail extending between and attached to the first leg member and the third leg member;

a first lower sail extending between and attached to the first leg member and the third leg member;

a second upper sail extending between and attached to the second leg member and the fourth leg member;

a second lower sail extending between and attached to the second leg member and the fourth leg member; and a first sail riser, the first sail riser being is pivotable about an axis that is collinear with a pivot axis of the locking leg hinge mechanism of the first leg member and supporting a portion of the first upper sail and portion of the first lower sail; and a first diagonal support member extending between the ridge beam and the first leg member, wherein the shelter device is configured such that:

in a first state, a first end of the diagonal support member is engaged with an attachment feature of the ridge beam and a second end of the diagonal support member is engaged with an attachment feature of the first leg member; and in a second state, at least the first end of the diagonal support member is disengaged with the attachment feature of the ridge beam.

26. The shelter device of claim 25, wherein the ridge beam further comprises a catch device secured to a lower surface of the ridge beam, the catch device comprising the attachment feature of the ridge beam.

27. The shelter device of claim 25, wherein, in the second state, the first end of the diagonal support member is a free end that is spaced apart from, and not connected to, the ridge beam.

28. The shelter device of claim 25, wherein the attachment features of the ridge beam and the first leg member each comprise concave cups configured to receive respective first and second ends of the diagonal support member.

* * * * *